US010571820B2

(12) United States Patent
Noguchi et al.

(10) Patent No.: US 10,571,820 B2
(45) Date of Patent: Feb. 25, 2020

(54) WHITE TONER FOR ELECTROSTATIC LATENT IMAGE DEVELOPMENT, ELECTROSTATIC IMAGE DEVELOPER, TONER CARTRIDGE, PROCESS CARTRIDGE, IMAGE FORMING APPARATUS, AND IMAGE FORMING METHOD

(71) Applicant: FUJI XEROX CO., LTD., Tokyo (JP)

(72) Inventors: Daisuke Noguchi, Kanagawa (JP); Yoshimasa Fujihara, Kanagawa (JP); Kazutsuna Sasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/109,786

(22) Filed: Aug. 23, 2018

(65) Prior Publication Data

US 2019/0196351 A1 Jun. 27, 2019

(30) Foreign Application Priority Data

Dec. 22, 2017 (JP) ..... 2017-246590

(51) Int. Cl.

| | |
|---|---|
| ***G03G 9/087*** | (2006.01) |
| ***G03G 9/093*** | (2006.01) |
| ***G03G 9/08*** | (2006.01) |

(52) U.S. Cl.

CPC ..... *G03G 9/08755* (2013.01); *G03G 9/0821* (2013.01); *G03G 9/08764* (2013.01); *G03G 9/08797* (2013.01); *G03G 9/09328* (2013.01); *G03G 9/09364* (2013.01); *G03G 9/09371* (2013.01); *G03G 9/09385* (2013.01)

(58) Field of Classification Search

CPC ..... G03G 9/08755; G03G 9/0821; G03G 9/0935; G03G 9/09364; G03G 9/09371; G03G 9/08797

See application file for complete search history.

(56) References Cited

U.S. PATENT DOCUMENTS

| | | | | |
|---|---|---|---|---|
| 8,293,440 | B2 | 10/2012 | Nakamura et al. | |
| 2006/0115758 | A1* | 6/2006 | Chang | G03G 9/0808 430/109.4 |
| 2013/0252161 | A1* | 9/2013 | Kawakami | G03G 15/08 430/108.3 |
| 2014/0369723 | A1* | 12/2014 | Takahashi | G03G 15/2014 399/321 |
| 2018/0067414 | A1* | 3/2018 | Murakami | G03G 9/0819 |

FOREIGN PATENT DOCUMENTS

| | | |
|---|---|---|
| JP | 2002-108021 | 4/2002 |
| JP | 2007-033719 | 2/2007 |
| JP | 2011-133804 | 7/2011 |

* cited by examiner

*Primary Examiner* — Christopher D Rodee
(74) *Attorney, Agent, or Firm* — JCIPRNET

(57) ABSTRACT

A white toner for electrostatic latent image development includes toner particles containing a binder resin, a white pigment, and a release agent, the binder resin containing an amorphous resin. In viscosity measurement using a capillary viscometer, a temperature-viscosity curve has a minimum value within a temperature range of 70° C. or more and 95° C. or less.

15 Claims, 3 Drawing Sheets

WHITE TONER FOR ELECTROSTATIC LATENT IMAGE DEVELOPMENT, ELECTROSTATIC IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2017-246590 filed Dec. 22, 2017.

BACKGROUND

(i) Technical Field

The present invention relates to a white toner for electrostatic latent image development, an electrostatic image developer, a toner cartridge, a process cartridge, an image forming apparatus, and an image forming method.

(ii) Related Art

An electrophotographic system for forming images uses a toner for electrophotographic latent image development (hereinafter, may be simply referred to as a "toner") as an image forming material and, for example, mostly uses a toner containing toner particles, which contain a binder resin and a coloring agent, and an external additive externally added to the toner particles. Also, a known technique for forming images in an electrophotographic system uses a colored toner containing a pigment of yellow, magenta, cyan, or etc. and a white toner containing a white pigment.

SUMMARY

In forming an image on a transparent recording medium such as a film, an OHP sheet, or the like, a white toner may be used as a backing for improving the color forming properties (hue) of a colored toner image formed with a colored toner on the surface of the transparent recording medium.

When a white fixed image is formed as a backing of a transparent recording medium, the occurrence of minute omission in the white fixed image causes a change in hue of a colored toner image formed as a base. In particular, minute omission in the white fixed image easily occurs at the front end in the transport direction of the transparent recording medium, and thus a color difference may occur between the front end and the rear end in the transport direction of the transparent recording medium.

According to an aspect of the invention, there is provided a white toner for electrostatic latent image development, the white toner including toner particles containing a binder resin, a white pigment, and a release agent, the binder resin containing an amorphous resin. In viscosity measurement using a capillary viscometer, a temperature-viscosity curve has a minimum value within a temperature range of 70° C. or more and 95° C. or less.

BRIEF DESCRIPTION OF THE DRAWINGS

Exemplary embodiments of the present invention will be described in detail based on the following figures, wherein.

DETAILED DESCRIPTION

Figure 1:
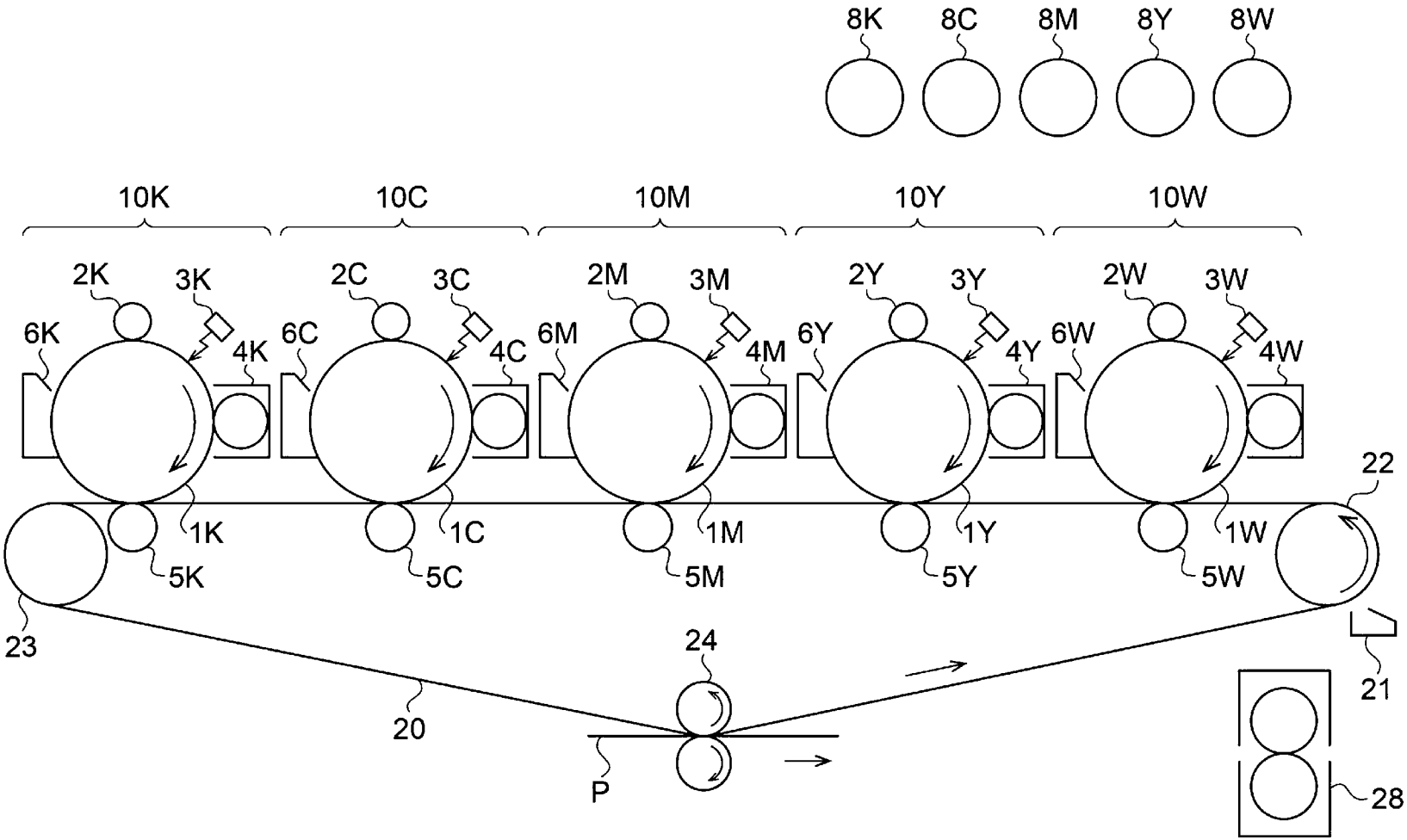
FIG. 1 is a schematic configuration diagram showing an image forming apparatus according to an exemplary embodiment of the present invention.

Exemplary embodiments of the present invention are described below.

(White Toner for Electrostatic Latent Image Development)

A white toner for electrostatic latent image development (may be simply referred to as a "toner" hereinafter) according to an exemplary embodiment of the present invention includes toner particles (hereinafter, may be referred to as "white toner particles" when the toner is a white toner) containing a binder resin, a white pigment, and a release agent, the binder resin containing an amorphous resin. In viscosity measurement using a capillary viscometer, a temperature-viscosity curve has a minimum value within a temperature range of 70° C. or more and 95° C. or less. The temperature-viscosity curve preferably has a minimum value within a temperature range of 75° C. or more and 95° C. or less and more preferably within a temperature range of 80° C. or more and 95° C. or less.

The viscosity measurement using a capillary viscometer is described. The measurement is performed by using a flow tester (CFT-500 manufactured by Shimadzu Corporation), and the measurement conditions are as follows.

The test pressure is 10 kgf/cm$^2$, the heating rate is 1° C./min, the preheating time is 300 seconds, the start temperature is 70° C., the central hole diameter of a sample table is 0.5 mm, and the hole thickness (length) is 1 mm.

Also, with constant-rate temperature increases, a sample of the toner is gradually heated and starts to flow out from the central hole of the sample table. With a further temperature increase, the sample in a molten state greatly flows out, and plunger fall is stopped and finished. The temperature-viscosity curve is formed from the apparent viscosity obtained by measuring an outflow amount at each temperature.

That is, the temperature-viscosity curve can be obtained by plotting measured values in measurement of the white toner according to the example embodiment by the constant-rate temperature increase from the start temperature to the attaining temperature.

Herein, the "minimum value" in the temperature-viscosity curve represents as follows.

When the temperature of the white toner according to the exemplary embodiment is increased by constant-rate temperature increases from the start temperature, the value of viscosity of the white toner is gradually decreased. Then, a decrease in viscosity per unit temperature increase is increased and, at a point, the viscosity turns from decrease to increase at a temperature as a boundary and is then again decreased. In this case, the point where the viscosity value turns from decrease to increase is referred to as the "minimum value".

In other words, in the obtained temperature-viscosity curve, there is observed a peak (valley) where the viscosity is decreased with a temperature increase (viscosity is decreased by an amount of viscosity decrease of at least 50 Pa·s/° C. or more with a temperature increase of 1° C.) and then turns to increase with a temperature increase (viscosity is increased by an amount of viscosity increase of at least 500 Pa·s/° C. or more with a temperature increase of 1° C.). This valley, that is, the point with the lowest value of viscosity in the curve turned upside down, is referred to as the "minimum value".

In the case where plural peaks (valleys) are present and the valleys overlap each other, when at least one of the plural valleys where the viscosity value turns from decrease to increase falls in a specific temperature range, the temperature-viscosity curve is considered to have the minimum value within the specific temperature range.

The white toner according to the exemplary embodiment has the temperature-viscosity curve having the minimum value within the temperature range of 70° C. or more and 95° C. or less.

The toner viscosity characteristic of having the minimum value within the temperature range is referred to as the "specific viscosity characteristic".

The white toner having the configuration described above according to the exemplary embodiment provides a white toner capable of forming a colored image having a little color difference between the front end and the rear end in the transport direction of a transparent recording medium.

The reason for this is unclear but is supposed as follows.

According to the purpose of improving hiding properties or the like, a large amount of the white pigment may be added to the toner particles in the white toner, and the large amount of white pigment has the tendency to inhibit bleeding of the release agent contained in the toner particles of the white toner.

In particular, as in using as the backing of a transparent recording medium, when a laminated toner image having a white toner image with a high toner applied amount as an uppermost layer on a colored toner image is fixed, the white fixed image with an ordinary white toner cannot be separated from a fixing unit because the white fixed image has low releasability from the fixing unit, and thus minute omission may occur in the white fixed image at the front end in the transport direction of the transparent recording medium.

When the white fixed image is formed for use as the backing of the transparent recording medium, the occurrence of minute omission in the white fixed image causes a change in color hue of the colored toner image as the base. In particular, the minute omission in the white fixed image easily occurs at the front end in the transport direction of the transparent recording medium, and thus a color difference may occur between the front end and the rear end in the transport direction of the transparent recording medium.

On the other hand, the white toner according to the exemplary embodiment has the temperature-viscosity curve with the minimum value within the temperature range of 70° C. or more and 95° C. or less. Therefore, it is considered that when the white toner image is fixed, the white toner according to the exemplary embodiment is easily molten or softened even in the initial stage of fixing where heat is not sufficiently applied, and the white toner containing a crystalline resin is more easily softened. Although unclear, it is considered that even when the toner includes a thin shell layer and thus contains a large amount of white pigment, the white pigment and the release agent have high dispersibility in the toner, and the white toner has the property of being sufficiently easily molten or softened. Therefore, the viscosity of the white toner is sufficiently decreased in the initial stage of fixing, and the release agent contained in the toner particles easily bleeds out and more easily bleeds out due to the thin shell layer.

Therefore, using the white toner according to the exemplary embodiment allows even the white toner image in the initial stage of fixing to exhibit satisfactory releasability from the fixing unit. It is thus possible to the form a colored image having a little color difference between the front end and the rear end in the transport direction of a transparent recording medium.

Details of the white toner according to the exemplary embodiment are described below.

The white toner according to the exemplary embodiment includes the toner particles containing the binder resin, the white pigment, and the release agent, the binder resin containing an amorphous resin. If required, the white toner particles according to the exemplary embodiment may include other additives. Also, if required, the white toner according to the exemplary embodiment may include external additives.

—Binder Resin—

The binder resin contains an amorphous resin. In particular, the amorphous resin is preferably used in combination with a crystalline resin as the binder resin.

The mass ratio (amorphous resin/crystalline resin) of the amorphous resin to the crystalline resin is preferably 50/50 or more and 97/3 or less and more preferably 70/30 or more and 93/7 or less.

Also, the content of the whole binder resin relative to the toner particles is preferably 40% by mass or more and 85% by mass or less, more preferably 50% by mass or more and 80% by mass or less, and still more preferably 60% by mass or more and 75% by mass or less.

The "crystalline" of the resin represents having a clear endothermic peak, not a stepwise change in endothermic quantity, in differential scanning calorimetry (DSC), and specifically represents that the half-width of an endothermic peak in measurement at a heating rate of 10 (° C./min) is within 10° C.

On the other hand, the "amorphous" of the resin represents that the half-width exceeds 10° C., that a stepwise change in endothermic quantity is shown, or that a clear endothermic peak is not observed.

The amorphous resin is described.

Examples of the amorphous resin include known amorphous resins such as an amorphous polyester resin, an amorphous vinyl resin (for example, styrene-(meth)acrylic resin or the like), an epoxy resin, a polycarbonate resin, a polyurethane resin, and the like. Among these, the amorphous polyester resin and the amorphous vinyl resin (for example, a styrene-(meth)acrylic resin or the like) are preferred in view of the low-temperature fixing properties and chargeability of the toner, and the amorphous polyester resin is more preferred.

The amorphous polyester resin is, for example, a condensation polymer of a polyhydric carboxylic acid and a polyhydric alcohol. The amorphous polyester resin used may be a commercial product or a synthesized product.

Examples of the polyhydric carboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, sebacic acid, and the like), alicyclic dicarboxylic acids (for example, cyclohexane dicarboxylic acid and the like), aromatic dicarboxylic acids (for example, terephthalic acid, isophthalic acid, phthalic acid, naphthalene dicarboxylic acid, and the like), and anhydrides or lower (for example, 1 or more and 5 or less carbon atoms) alkyl esters thereof. Among these, for example, an aromatic dicarboxylic acid is preferred as the polyhydric carboxylic acid.

The dicarboxylic acid may be used in combination with a tri- or higher-hydric carboxylic acid having a crosslinked structure or branched structure as the polyhydric carboxylic acid. Examples of the tri- or higher-hydric carboxylic acid include trimellitic acid, pyromellitic acid, anhydrides or lower (for example, 1 or more and 5 or less carbon atoms) alkyl esters thereof, and the like.

The polyhydric carboxylic acids may be used alone or in combination of two or more.

Examples of the polyhydric alcohol include aliphatic diols (for example, ethylene glycol, diethylene glycol, triethylene glycol, propylene glycol, butanediol, hexanediol, neopentyl glycol, and the like), alicyclic diols (for example, cyclohexanediol, cyclohexane dimethanol, hydrogenated bisphenol A, and the like), aromatic diols (for example, bisphenol A ethylene oxide adduct, bisphenol A propylene oxide adduct, and the like), and the like. Among these, the polyhydric alcohol is preferably an aromatic diol or alicyclic diol and more preferably an aromatic diol.

The diol may be used in combination with a tri- or higher-hydric alcohol having a crosslinked structure or branched structure as the polyhydric alcohol. Examples of the tri- or higher-hydric alcohol include glycerin, trimethylolpropane, and pentaerythritol.

The polyhydric alcohols may be used alone or in combination of two or more.

The amorphous polyester resin can be produced by a known production method. Specifically, the amorphous polyester resin can be produced by, for example, a method of reaction at a polymerization temperature of 180° C. or more and 230° C. or less, if required, in a reaction system under reduced pressure while the water and alcohol produced in the condensation is removed.

When a monomer used as a raw material is insoluble or incompatible at the reaction temperature, the monomer may be dissolved by adding a solvent having a high boiling point as a solubilizer. In this case, polycondensation reaction is performed while the solubilizer is distilled off. When a monomer with low compatibility is present, the monomer with low compatibility may be previously condensed with an acid or alcohol to be polycondensed with the monomer and then polycondensed with a main component.

Besides the unmodified amorphous polyester resins described above, examples of the amorphous polyester resin include a modified amorphous polyester resin. The modified amorphous polyester resin is an amorphous polyester resin in which a bonding group other than an ester bond is present, or an amorphous polyester resin in which a resin component different from an amorphous polyester resin component is bonded through a covalent bond, an ionic bond, or the like. Examples of the modified amorphous polyester resin include an amorphous polyester resin in which a functional group such as an isocyanate group or the like, which reacts with an acid group or hydroxyl group, is introduced in an end, and a resin having an end modified by reaction with an active hydrogen compound.

The modified amorphous polyester resin is preferably a urea-modified amorphous polyester resin (also simply referred to as a "urea-modified polyester resin" hereinafter).

The urea-modified polyester resin may be a urea-modified polyester resin produced by reaction (at least one reaction of crosslinking reaction and extension reaction) of an amorphous polyester resin having an isocyanate group (amorphous polyester prepolymer) with an amine compound. The urea-modified polyester resin may contain both a urea bond and a urethane bond.

The amorphous polyester prepolymer having an isocyanate group is, for example, an amorphous polyester prepolymer produced by reacting an amorphous polyester resin, which is a polycondensation product of a polyhydric carboxylic acid and a polyhydric alcohol and has active hydrogen, with a polyvalent isocyanate compound. Examples of a group having active hydrogen possessed by the amorphous polyester resin include a hydroxyl group (an alcoholic hydroxyl group or phenolic hydroxyl group), an amino group, a carboxyl group, a mercapto group, and the like, and an alcoholic hydroxyl group is preferred.

Examples of a polyhydric carboxylic acid and a polyhydric alcohol in the amorphous polyester prepolymer having an isocyanate group include the same compounds as the polyhydric carboxylic acids and polyhydric alcohols described above for the amorphous polyester resin.

Examples of the polyvalent isocyanate compound include aliphatic polyisocyanates (teteramethylene diisocyanate, hexamethylene diisocyanate, 2,6-diisocyanatomethyl caproate, and the like); alicyclic polyisocyanates (isophorone diisocyanate, cyclohexylmethane diisocyanate, and the like); aromatic diisocyanates (tolylene diisocyanate, diphenylmethane diisocyanate, and the like); araliphatic diisocyanates ($\alpha,\alpha,\alpha',\alpha'$-tetramethylxylylene diisocyanate and the like); isocyanurates; and polyvalent isocyanates produced by blocking these polyisocyanates with a blocking agent such as a phenol derivative, oxime, caprolactam, or the like.

The polyvalent isocyanate compounds may be used alone or in combination of two or more.

The ratio of the polyvalent isocyanate compound is preferably 1/1 or more and 5/1 or less, more preferably 1.2/1 or more and 4/1 or less, and still more preferably 1.5/1 or more and 2.5/1 or less in terms of equivalent ratio [NCO]/[OH] of isocyanate group [NCO] to hydroxyl group [OH] of the hydroxyl group-containing amorphous polyester prepolymer.

The content of a component derived from the polyvalent isocyanate compound in the amorphous polyester prepolymer having an isocyanate group is preferably 0.5% by mass or more and 40% by mass or less, more preferably 1% by mass or more and 30% by mass or less, and still more preferably 2% by mass or more and 20% by mass or less relative to the whole of the amorphous polyester prepolymer having an isocyanate group.

The number of isocyanate groups contained per molecule of the amorphous polyester prepolymer having an isocyanate group is preferably 1 or more on average, more preferably 1.5 or more and 3 or less on average, and still more preferably 1.8 or more and 2.5 or less on average.

Examples of the amine compound reacted with the amorphous polyester prepolymer having an isocyanate group include diamines, tri- or higher-valent polyamines, amino alcohols, amino mercaptans, amino acids, compounds produced by blocking the amino groups of these compounds, and the like.

Examples of the diamines include aromatic diamines (phenylenediamine, diethyltoluenediamine, 4,4'-diaminodiphenylmethane, and the like); alicyclic diamines (4,4'-diamino-3,3'-dimethyldicyclohexylmethane), diamine cyclohexane, isophorone diamine, and the like); aliphatic diamines (ethylenediamine, tetramethylenediamine, hexamethylenediamine, and the like); and the like.

Examples of tri- or higher-valent polyamines include diethylenetriamine, triethylenetetramine, and the like.

Examples of amino alcohols include ethanolamine, hydroxyethyl aniline, and the like.

Examples of amino mercaptans include aminoethyl mercaptan, aminopropyl mercaptan, and the like.

Examples of amino acids include aminopropionic acid, aminocaproic acid, and the like.

Examples of compounds produced by blocking the amino groups of these amine compounds include a ketimine compound produced from an amine compound, such as a diamine, tri- or higher-valent polyamine, amino alcohol, amino mercaptan, amino acid, or the like, and a ketone compound (acetone, methyl ethyl ketone, methyl isobutyl ketone, or the like), an oxazoline compound, and the like.

Among these amine compounds, the ketimine compound is preferred.

The amine compounds may be used alone or in combination of two or more.

The urea-modified polyester resin may be a resin having a molecular weight after reaction adjusted by using a terminating agent (also referred to as a "crosslinking/extension reaction terminating agent" hereinafter), which terminates at least one reaction of crosslinking reaction and extension reaction, in the reaction (at least one reaction of crosslinking reaction and extension reaction) of the amorphous polyester resin (amorphous polyester prepolymer) having an isocyanate group with an amine compound.

Examples of the crosslinking/extension reaction terminating agent include monoamines (diethylamine, dibutylamine, butylamine, laurylamine, and the like), compounds (ketamine compounds) produced by blocking these monoamines, and the like.

The ratio of the amine compound is preferably 1/2 or more and 2/1 or less, more preferably 1/1.5 or more and 1.5/1 or less, and still more preferably 1/1.2 or more and 1.2/1 or less in terms of equivalent ratio $[NCO]/[NH_x]$ of isocyanate group [NCO] in the amorphous polyester prepolymer having an isocyanate group to amino group $[NH_x]$ in the amine.

The urea-modified polyester resin is preferably a urea-modified polyester resin produced by reaction (at least one reaction of crosslinking reaction and extension reaction) of a polyester resin having an isocyanate group (preferred as a "polyester prepolymer" hereinafter) with an amine compound. The urea-modified polyester resin may contain both a urea bond and a urethane bond.

The polyester prepolymer is, for example, the reaction product of a polyester having a group having active hydrogen and a polyvalent isocyanate compound. Examples of a group having active hydrogen include a hydroxyl group (an alcoholic hydroxyl group or phenolic hydroxyl group), an amino group, a carboxyl group, a mercapto group, and the like, and an alcoholic hydroxyl group is preferred. Examples of the polyvalent isocyanate compound include aliphatic polyisocyanates (teteramethylene diisocyanate, hexamethylene diisocyanate, 2,6-diisocyanatomethyl caproate, and the like); alicyclic polyisocyanates (isophorone diisocyanate, cyclohexylmethane diisocyanate, and the like); aromatic diisocyanates (tolylene diisocyanate, diphenylmethane diisocyanate, and the like); araliphatic diisocyanates ($\alpha,\alpha,\alpha',\alpha'$-tetramethylxylylene diisocyanate and the like); isocyanurates; and polyvalent isocyanates produced by blocking these polyisocyanates with a blocking agent such as a phenol derivative, oxime, caprolactam, or the like. The polyvalent isocyanate compounds may be used alone or in combination of two or more.

The content of a part derived from the polyvalent isocyanate compound in the polyester prepolymer is preferably 0.5% by mass or more and 40% by mass or less, more preferably 1% by mass or more and 30% by mass or less, and still more preferably 2% by mass or more and 20% by mass or less relative to the whole of the polyester prepolymer. The average number of isocyanate groups per molecule of the polyester prepolymer is preferably 1 or more, more preferably 1.5 or more and 3 or less, and still more preferably 1.8 or more and 2.5 or less.

Examples of the amine compound reacted with the polyester prepolymer include diamines, tri- or higher-valent polyamines, amino alcohols, amino mercaptans, amino acids, compounds produced by blocking the amino groups of these amine compounds, and the like.

Examples of the diamines include aromatic diamines (phenylenediamine, diethyltoluenediamine, 4,4'-diaminodiphenylmethane, and the like); alicyclic diamines (4,4'-diamino-3,3'-dimethyldicyclohexylmethane), diamine cyclohexane, isophorone diamine, and the like); aliphatic diamines (ethylenediamine, tetramethylenediamine, hexamethylenediamine, and the like); and the like. Examples of tri- or higher-valent polyamines include diethylenetriamine, triethylenetetramine, and the like. Examples of amino alcohols include ethanolamine, hydroxyethyl aniline, and the like. Examples of amino mercaptans include aminoethyl mercaptan, aminopropyl mercaptan, and the like. Examples of amino acids include aminopropionic acid, aminocaproic acid, and the like.

Examples of compounds produced by blocking the amino groups of these amine compounds include a ketimine compound derived from the amine compound and a ketone compound (acetone, methyl ethyl ketone, methyl isobutyl ketone, or the like), an oxazoline compound, and the like.

The amine compound is preferably the ketimine compound. These amine compounds may be used alone or in combination of two or more.

The urea-modified polyester resin may be a resin having a molecular weight after reaction adjusted by using a terminating agent (also referred to as a "crosslinking/extension reaction terminating agent" hereinafter), which terminates at least one reaction of crosslinking reaction and extension reaction, in the reaction (at least one reaction of crosslinking reaction and extension reaction) of the polyester resin (polyester prepolymer) with an amine compound. Examples of the crosslinking/extension reaction terminating agent include monoamines (diethylamine, dibutylamine, butylamine, laurylamine, and the like), compounds (ketamine compounds) produced by blocking these monoamines, and the like.

The amorphous vinyl resin is particularly preferably a styrene-(meth)acrylic resin.

The styrene-(meth)acrylic resin may be a copolymer produced by copolymerizing another monomer in addition to a styrene-based monomer and a (meth)acrylic monomer.

The term "(meth)acrylic" or the like is an expression including both "acrylic" and "methacrylic".

The styrene-based monomer is a monomer having a styrene skeleton, and specific examples thereof include styrene; vinylnaphthalene; alkyl-substituted styrene such as $\alpha$-methylstyrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, and the like; aryl-substituted styrene such as p-phenylstyrene and the like; alkoxy-substituted styrene such as p-methoxystyrene and the like; halogen-substituted styrene such as p-chlorostyrene, 3,4-dichlorostyrene, 4-fluorostyrene, 2,5-difluorostyrene, and the like; nitro-substituted styrene such as m-nitrostyrene, o-nitrostyrene, p-nitrostyrene, and the like; and the like. Among these, styrene, p-ethylstyrene, p-n-butylstyrene, and the like are preferred as the styrene-based monomer.

These styrene-based monomers may be used alone or in combination of two or more.

The (meth)acrylic monomer is a monomer having a (meth)acryloyl group.

Examples of a (meth)acrylic acid ester include (meth) acrylic acid alkyl esters such as methyl (meth)acrylate, ethyl (meth)acrylate, n-propyl (meth)acrylate, n-butyl (meth) acrylate, n-pentyl (meth)acrylate, n-hexyl (meth)acrylate, n-heptyl (meth)acrylate, n-octyl (meth)acrylate, n-decyl (meth)acrylate, n-dodecyl (meth)acrylate, n-lauryl (meth) acrylate, n-tetradecyl (meth)acrylate, n-hexadecyl (meth) acrylate, n-octadecyl (meth)acrylate, isopropyl (meth)acrylate, isobutyl (meth)acrylate, tert-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth)acrylate, octyl (meth)acrylate, isodecyl (meth)acrylate, isolauryl (meth)acrylate, stearyl (meth)acrylate, and the like.

Besides the (meth)acrylic acid esters described above, examples of the (meth)acrylic monomer include (meth) acrylic acid, decanediol diacrylate, and the like.

These (meth)acrylic monomers may be used alone or in combination of two or more.

Examples of the other monomer include ethylenically unsaturated nitriles (acrylonitrile, methacrylonitrile, and the like), vinyl ethers (vinyl methyl ether, vinyl isobutyl ether, and the like), vinyl ketones (vinyl methyl ketone, vinyl ethyl ketone, vinyl isopropenyl ketone, and the like), divinyl compounds (divinyl adipate and the like), olefins (ethylene, propylene, butadiene, and the like), and the like.

A method for producing the styrene-(meth)acrylic resin is not particularly limited, and a known production method can be used.

The characteristics of the amorphous resin are described.

The glass transition temperature (Tg) of the amorphous resin is preferably 50° C. or more and 80° C. or less and more preferably 50° C. or more and 65° C. or less.

The glass transition temperature can be determined from a DSC curve obtained by differential scanning calorimetry (DSC). More specifically, the glass transition temperature can be determined by "Extrapolation Glass Transition Starting Temperature" described in Determination of Glass Transition Temperature of JIS K7121-1987 "Testing methods for transition temperatures of plastics".

The weight-average molecular weight (Mw) of the amorphous resin is preferably 5,000 or more and 1,000,000 or less and more preferably 7,000 or more and 500,000 or less.

The number-average molecular weight (Mn) of the amorphous resin is preferably 2,000 or more and 100,000 or less.

The molecular weight distribution Mw/Mn of the amorphous resin is preferably 1.5 or more and 100 or less and more preferably 2 or more and 60 or less.

The weight-average molecular weight and number-average molecular weight are measured by gel permeation chromatography (GPC). The GPC molecular weight measurement is performed by using GPC.HLC-8120GPC manufactured by Tosoh Corporation as a measurement apparatus, TSK gel Super HM-M (15 cm) manufactured by Tosoh Corporation as a column, and THF as a solvent. The weight-average molecular weight and number-average molecular weight are calculated from the measurement results by using a molecular weight calibration curve formed by using monodisperse polystyrene standard samples.

The crystalline resin is described.

Examples of the crystalline resin include known crystalline resins such as a crystalline polyester resin, a crystalline vinyl resin (for example, a polyalkylene resin, a long-chain alkyl (meth)acrylate resin, or the like), and the like. In particular, when the crystalline polyester resin is used, the white toner can be easily imparted with the "specific viscosity characteristic" described above.

The crystalline polyester resin is, for example, a condensation polymer of a polyhydric carboxylic acid and a polyhydric alcohol.

Examples of the polyhydric carboxylic acid include aliphatic dicarboxylic acids (for example, oxalic acid, succinic acid, glutaric acid, adipic acid, suberic acid, azelaic acid, sebacic acid, 1,9-nonanedicarbocylic acid, 1,10-decanedicarboxylic acid, 1,12-dodecanedicarboxylic acid, 1,14-tetradecanedicaroxylic acid, 1,18-octadecanedicarboxylic acid, and the like), aromatic dicarboxylic acids (for example, dibasic acids such as phthalic acid, isophthalic acid, terephthalic acid, naphthalene-2,6-dicarboxylic acid, and the like), and anhydrides or lower (for example, 1 or more and 5 or less carbon atoms) alkyl esters thereof.

The dicarboxylic acid may be used in combination with a tri- or higher-hydric carboxylic acid having a crosslinked structure or branched structure as the polyhydric carboxylic acid. Examples of the trihydric carboxylic acid include aromatic carboxylic acids (for example, 1,2,3-benzene tricarboxylic acid, 1,2,4-benzene tricarboxylic acid, 1,2,4-naphthalene tricarboxylic acid, and the like, and anhydrides or lower (for example, 1 or more and 5 or less carbon atoms) alkyl esters thereof.

Any one of these dicarboxylic acids may be used in combination with a dicarboxylic acid having a sulfonic acid group or a dicarboxylic acid having an ethylenically double bond as the polyhydric carboxylic acid.

The polyhydric carboxylic acids may be used alone or in combination of two or more.

Examples of the polyhydric alcohol include aliphatic diols (for example, linear aliphatic diols each having a main chain part having 7 or more and 20 or less carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecaediol, 1,14-eicosanedecanediol, and the like. Among these, the aliphatic diol is preferably 1,8-octanediol, 1,9-nonanediol, or 1,10-decanediol.

The diol may be used in combination with a tri- or higher-hydric alcohol having a crosslinked structure or branched structure as the polyhydric alcohol. Examples of the tri- or higher-hydric alcohol include glycerin, trimethylolethane, trimethylolpropane, pentaerythritol, and the like.

The polyhydric alcohols may be used alone or in combination of two or more.

The content of the aliphatic diol as the polyhydric alcohol is preferably 80 mol % or more and more preferably 90 mol % or more.

In order to easily form a crystal structure, the crystalline polyester resin is preferably a condensation polymer using a polymerizable monomer having a linear aliphatic group rather than a polymerizable monomer having an aromatic group.

In particular, the crystalline polyester resin preferably contains a constituent unit derived from a polyhydric carboxylic acid component containing an aliphatic carboxylic acid having 5 or more and 12 or less carbon atoms (preferably, 7 or more and 10 or less carbon atoms) and a constituent unit derived from a polyhydric alcohol component containing an aliphatic diol having 2 or more and 10 or less carbon atoms (preferably, 4 or more and 10 or less carbon atoms).

The crystalline polyester resin used may be a commercial product or a synthesized product. Like the amorphous polyester resin, the crystalline polyester resin can be produced by a known production method.

The characteristics of the crystalline resin are described.

The melting temperature of the crystalline resin is preferably 50° C. or more and 100° C. or less, more preferably 55° C. or more and 90° C. or less, and still more preferably 60° C. or more and 85° C. or less.

The melting temperature can be determined from a DSC curve obtained by differential scanning calorimetry (DSC) according to "Melting Peak Temperature" described in Determination of Melting Temperature of JIS K7121-1987 "Testing methods for transition temperatures of plastics".

The weight-average molecular weight (Mw) of the crystalline resin is preferably 6,000 or more and 35,000 or less.

The content of the crystalline resin is preferably 5% by mass or more and 25% by mass or less, more preferably 5% by mass or more and 20% by mass or less, and still more preferably 5% by mass or more and 15% by mass or less relative to the toner particles.

When the content of the crystalline polyester resin is within the range described above, the toner can be easily imparted with the specific viscosity characteristic. Specifically, when the content of the crystalline polyester resin is 5% by mass or more relative to the toner particles, it is advantageous from the viewpoint that the viscosity of the toner is sufficiently decreased during fixing, and thus the bleeding property of the release agent is improved, thereby forming a colored image having a little color difference between the front end and the rear end in the transport direction of a transparent recording medium. In addition, when the content of the crystalline resin is 25% by mass or less relative to the toner particles, it is advantageous in view of toner storage properties because the amount of the crystalline resin bleeding out to the toner surfaces is suppressed during long-term storage.

(White Pigment)

The white toner according to the exemplary embodiment contains the white pigment as a coloring agent.

A material of the white pigment used in the exemplary embodiment is not particularly limited. Examples thereof include inorganic pigments (for example, titanium oxide, barium sulfate, lead oxide, zinc oxide, lead titanate, potassium titanate, barium titanate, strontium titanate, zirconia, antimony trioxide, lead white, zinc sulfide, barium carbonate, and the like), organic pigments (for example, a polystyrene resin, a urea formalin resin, a polyacrylic resin, a polystyrene/acrylic resin, a polystyrene/butadiene resin, an alkyl bismelamine resin, and the like), and the like.

Also, a pigment having a hollow structure may be used. Examples of the pigment having a hollow structure include hollow inorganic pigments (for example, hollow silica, hollow titanium oxide, hollow calcium carbonate, hollow zinc oxide, zinc oxide tubes/particles, and the like), hollow organic particles (for example, a styrene resin, an acrylic resin, a styrene/acrylic resin, a styrene/acrylic acid ester/acrylic acid resin, a styrene/butadiene resin, a styrene/methyl methacrylate/butadiene resin, an ethylene/vinyl acetate resin, an acrylic acid/vinyl acetate resin, an acrylic acid/maleic acid resin, and the like), and the like.

Further examples include heavy calcium carbonate, light calcium carbonate, aluminum hydroxide, satin white, talc, calcium sulfate, magnesium oxide, magnesium carbonate, amorphous silica, colloidal silica, white carbon, kaolin, fired kaolin, delaminated kaolin, aluminosilicate salts, sericite, bentonite, smectite, and the like.

Among these, titanium oxide particles are preferred as the white pigment.

These white pigments may be used alone or in combination of two or more.

The white pigment may be surface-treated or used as the white pigment in combination with a dispersant according to demand.

For example, from the viewpoint of improving whiteness and hiding properties, the content of the white pigment relative to the white toner particles is preferably 15% by mass or more and 45% by mass or less, more preferably 30% by mass or more and 45% by mass or less, and still more preferably 35% by mass or more and 45% by mass or less.

When the content of the white pigment is within the range described above, bleed-out of the release agent from the toner particles is generally easily inhibited, and thus a color difference is considered to easily occur between the front end and the rear end in the transport direction of a transparent recording medium. However, the white toner according to the exemplary embodiment has the specific viscosity characteristic and thus, even when the content of the white pigment is within the above range, it is possible to form a colored image having a little color difference between the front end and the rear end in the transport direction of a transparent recording medium.

The ratio of the content of the release agent to the content of the white pigment is preferably 0.08 or more and 0.25 or less and more preferably 0.12 or more and 0.20 or less.

The white toner according to the exemplary embodiment has the specific viscosity characteristic and thus, even when the ratio of the content of the release agent to the content of the white pigment is within the range described above, it is possible to form a colored image having a little color difference between the front end and the rear end in the transport direction of a transparent recording medium.

The number-average particle diameter D50p of the white pigment is preferably 50 nm or more and less than 800 nm, more preferably 100 nm or more and less than 700 nm, and still more preferably 200 nm or more and less than 600 nm.

The particle size distribution of the white pigment is calculated as follows.

The white toner particles according to the exemplary embodiment are mixed and embedded with an epoxy resin and solidified by being allowed to stand overnight. Then, a thin section having, for example, a thickness of about 250 nm or more and 450 nm or less, is formed by using an ultramicrotome apparatus (Ultracut UCT manufactured by Leica Inc.).

The resultant thin section is observed with an ultra-high resolution field emission scanning electron microscope (S-4800 manufactured by Hitachi High-Technologies Co., Ltd.) to confirm the white pigment in the white toner particles. When the white pigment has an unclear contour, observation can be again performed after the thickness of the observation thin section is adjusted. When many blank defects are present in the white toner particles, there is the possibility that omission occurs in the white pigment when the thin section is formed. Therefore, the thin section is preferably adjusted to be rather thick. In addition, when the contour of the white pigment cannot be easily distinguished because most of the white pigment in the white toner particles is seen to overlap, there is the possibility that plural white pigment particles are observed to overlap each other because the thin section is excessively thick. Therefore, the thin section is preferably adjusted to be rather thin.

The observed photograph is electronized and input to an image analysis software (Win ROOF) manufactured by Mitani Corporation. Then, the particle diameter of the white pigment in the white toner particles is determined according to, for example, the following procedures.

That is, a toner sectional area in the embedding agent is selected as a selection object and binarized by using an "automatic binarization-discriminant analysis method" of a "binarization processing" command, to separate between the white pigment and the binder resin part. In this case, it is confirmed by comparison with the image before binarization whether the white pigment particles are separated from each other in a white pigment region portion of the binarized image. When plural particles are connected to each other and binarized, the threshold value of binarization is adjusted so that the particles are independently, one by one, binarized or the region is manually divided and corrected so that each of the particles forms a white pigment region portion. The extracted white pigment region is selected, and the maximum Feret diameter is determined as the particle diameter of the white pigment.

When binarization cannot be normally performed due to the photographic density and noise, the image may be clarified by "filter-median" processing or edge extraction processing and then boundaries may be manually set.

For calculating the number-average particle diameter of the white pigment, measured values of 300 or more particles of the white pigment are determined by using an image showing 10 or more and 100 or less of white pigment particles in each viewing field. A particle size distribution is formed based on the measured values, and a number-based cumulative distribution from the smaller diameter side is formed based on the particle size distribution. In the particle size distributions, the cumulative 50% particle diameter is defined as the number-average particle diameter D50p.

When the number-average particle diameter of the white pigment is calculated by using only the white pigment, for example, the white pigment is lightly mixed with zirconia particles of 100 μm, and the white pigment adhering to the surfaces of the zirconia particles is observed with an electron microscope (for example, S-4800, manufactured by Hitachi High-Technologies Co., Ltd.). The number-average particle diameter can be calculated by the same image analysis as described above using the resultant electronized image. In this case, when the white pigment has an aggregated state, the image is corrected by manually dividing the region so that each of the white pigment particles forms a white pigment region portion. Also, the white pigment is previously adhered to a conductive tape and observed with an electron microscope to prepare an image. Based on comparison between the shapes of the white pigment to be observed, the white pigment particles which are crushed and deformed by mixing with the zirconia particles are excluded from a measurement object.

When the white pigment on the surfaces of the zirconia particles is overlapped or aggregated and is thus hard to observe, improvement can be made by decreasing the ratio of the white pigment mixed or by adjusting mixing conditions.

—Release Agent—

Examples of the release agent include hydrocarbon-based wax; natural wax such as carnauba wax, rice bran wax, candelilla wax, and the like; synthetic or mineral-based/petroleum wax such as montan wax and the like; ester-based wax such as fatty acid esters, montanic acid esters, and the like; and the like. The release agent is not limited to these.

The melting temperature of the release agent is preferably 50° C. or more and 110° C. or less and more preferably 60° C. or more and 100° C. or less.

The melting temperature of the release agent can be determined from a DSC curve obtained by differential scanning calorimetry (DSC) according to "Melting Peak Temperature" described in Determination of Melting Temperature of JIS K7121-1987 "Testing methods for transition temperatures of plastics".

The content of the release agent is, for example, preferably 1% by mass or more and 20% by mass or less and more preferably 5% by mass or more and 15% by mass or less relative to the whole toner particles.

—Other Additives—

Examples of other additives include known additives such as a magnetic material, a charge control agent, an inorganic powder, and the like. These additives are contained as internal additives in the toner particles.

—Characteristics of Toner Particle—

The toner particles may be toner particles with a single-layer structure or toner particles with a so-called core-shell structure configurated by a core part (core particle) and a coating layer (shell layer) which coats the core part.

The toner particles with a core-shell structure are configurated by, for example, a core part containing a binder resin and, if required, other additives such as a coloring agent, a release agent, etc., and a coating layer containing the binder resin.

The thickness of the shell layer of the toner particles of the white toner is preferably 0.05 μm or more and 0.35 μm or less, more preferably 0.10 μm or more and 0.30 μm or less, and still more preferably 0.10 μm or more and 0.20 μm or less.

With the shell layer having a thickness within the range described above, the white toner can be easily provided with the specific viscosity characteristic. Specifically, the shell layer having a thickness of 0.05 μm or more is advantageous from the viewpoint of toner storage properties because the binder resin hardly bleeds out to the toner particle surfaces in long-term storage. The shell layer having a thickness of 0.35 μm or less is advantageous from the viewpoint of forming a colored image with a little color difference between the front end and the rear end in the transport direction of a transparent recording medium because the release agent easily bleeds out.

The thickness of the shell layer is measured by the following method.

The toner particles are embedded with an epoxy resin and cut by using a diamond knife to form a thin section. The thin section is observed with a transmission electron microscope (TEM), and the sectional images of plural toner particles are photographed. The thickness of the shell layer is measured at 20 points in the sectional image of the toner particles, and an average value is determined. When the coating layers are not easily observed in the sectional images, dyeing may be performed for observation.

The volume-average particle diameter (D50v) of the toner particles is preferably 2 μm or more and 15 μm or less and more preferably 4 μm or more and 10 μm or less.

The various average particle diameters and various particle size distribution indexes of the toner particles are measured by using Coulter Multisizer II (manufactured by Beckman Coulter Inc.) and an electrolytic solution ISOTON-II (manufactured by Beckman Coulter Inc.).

In the measurement, 0.5 mg or more and 50 mg or less of a measurement sample is added to 2 ml of a 5% aqueous solution of a surfactant (preferably sodium alkylbenzene sulfonate) serving as a dispersant. The resultant mixture is added to 100 ml or more and 150 ml or less of the electrolytic solution.

The electrolytic solution in which the sample has been suspended is dispersed for 1 minute by using an ultrasonic disperser, and the particle size distribution of particles having a particle diameter within a range of 2 μm or more and 60 μm or less is measured by using Coulter Multisizer II and an aperture having an aperture diameter of 100 μm. The number of particles sampled is 50,000.

Each of volume-based and number-based cumulative distributions is formed from the smaller diameter side for particle size ranges (channels) divided based on the measured particle size distribution. In the particle size distributions, the cumulative 16% particle diameters are defined as the volume particle diameter D16v and number particle diameter D16p, the cumulative 50% particle diameters are defined as the volume-average particle diameter D50v and cumulative number-average particle diameter D50p, and the cumulative 84% particle diameters are defined as the volume particle diameter D84v and number particle diameter D84p.

By using these particle diameters, the volume particle size distribution index (GSDv) and the number particle size distribution index (GSDp) are calculated as $(D84v/D16v)^{1/2}$ and $(D84p/D16p)^{1/2}$, respectively.

The average circularity of the toner particles is preferably 0.92 or more and 1.00 or less and more preferably 0.94 or more and 0.98 or less.

The average circularity of the toner particles is determined by (equivalent circle circumference length)/(circumference length) [(circumference length of a circle having the same projection area as a particle image)/(circumference length of particle projection image)]. Specifically, the average circularity is a value measured by the following method.

First, the toner particles used as a measurement object are collected by suction to form a flat flow, a particle image is captured as a still image by instantaneous strobe light emission, and the average circularity is determined by image analysis of the particle image using a flow particle image analyzer (FPIA-3000 manufactured by Sysmex Corporation). The number of particles sampled for determining the average circularity is 3500.

When the toner contains an external additive, the toner (developer) as a measurement object is dispersed in water containing a surfactant, and then the external additive is removed by ultrasonic treatment to produce the toner particles.

(External Additive)

The external additive is, for example, inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

The surfaces of inorganic particles used as the external additive may be hydrophobically treated. The inorganic particles are hydrophobically treated by, for example, dipping in a hydrophobic treatment agent. Examples of the hydrophobic treatment agent include, but are not limited to, a silane coupling agent, silicone oil, titanate-based coupling agent, an aluminum-based coupling agent, and the like. These may be used alone or in combination of two or more.

The amount of the hydrophobic treatment agent is, for example, generally 1 part by mass or more and 10 parts by mass or less relative to 100 parts by mass of inorganic particles.

Other examples of the external additive include resin particles (for example, resin particles of polystyrene, polymethyl methacrylate (PMMA), melamine resin, and the like), cleaning activators (for example, a higher fatty acid metal salt such as zinc stearate, and fluorine-based polymer particles), and the like.

The amount of the external additive externally added is, for example, preferably 0.01% by mass or more and 5% by mass or less and more preferably 0.01% by mass or more and 2.0% by mass or less relative to the toner particles.

(Method for Producing Toner)

Next, a method for producing the toner according to the exemplary embodiment is described.

The toner according to the exemplary embodiment is produced by producing the toner particles and then externally adding the external additive to the toner particles.

The toner particles may be produced by a dry method (for example, a kneading-grinding method or the like) or a wet method (for example, an aggregation coalescence method, a suspension polymerization method, a dissolution suspension method, or the like). These methods are not particularly limited, and a known method is used.

Among these, the aggregation coalescence method is preferred for producing the toner particles.

Specifically, for example, when the toner particles are produced by the aggregation coalescence method, the toner particles are produced as follows.

A resin particle dispersion in which resin particles used as the binder resin are dispersed is prepared (preparation of a resin particle dispersion). The resin particles (if required, other particles) are aggregated in the resin particle dispersion (if required, a dispersion mixture with another particle dispersion) to form aggregated particles (formation of aggregated particles). The aggregated particles are fused and coalesced by heating the aggregated particle dispersion in which the aggregated particles are dispersed, thereby forming the toner particles (fusion/coalescence).

Each of the processes is described in detail below. In the description below, the method for producing the toner particles containing the coloring agent and the release agent is described. Of course, other additives other than the coloring agent and the release agent may be used.

—Preparation of Resin Particle Dispersion—

In addition to the resin particle dispersion in which the resin particles used as the binder resin are dispersed, there are prepared, for example, a coloring agent particle dispersion in which the coloring agent particles are dispersed, and a release agent particle dispersion in which the release agent particles are dispersed.

The resin particle dispersion is prepared by, for example, dispersing the resin particles in a dispersion medium with a surfactant.

The dispersion medium used in the resin particle dispersion is, for example, an aqueous medium.

Examples of the aqueous medium include water such as distilled water, ion exchange water, and the like, alcohols, and the like. These may be used alone or in combination of two or more.

Examples of the surfactant include sulfate ester salt-based, sulfonic acid salt-based, phosphate ester-based, and soap-based anionic surfactants and the like: amine salt-type and quaternary ammonium salt-type cationic surfactants and the like; polyethylene glycol-based, alkylphenol ethylene oxide adduct-based, and polyhydric alcohol-based nonionic surfactants and the like; and the like. Among these, an anionic surfactant or cationic surfactant is particularly used. A nonionic surfactant may be used in combination with the anionic surfactant or cationic surfactant.

These surfactants may be used alone or in combination of two or more.

A method for dispersing the resin particles in the dispersion medium of the resin particle dispersion is, for example, a general dispersion method using a rotary-shear homogenizer, a ball mill having media, a sand mill, a dyno mill, or the like. The resin particles may be dispersed in the resin particle dispersion by a phase inversion emulsion method according to the type of the resin particles.

The phase inversion emulsion method is a method including dissolving a resin to be dispersed in a hydrophobic organic solvent which can dissolve the resin, neutralizing an organic continuous phase (O phase) by adding a base thereto, and then performing resin inversion (so-called phase inversion) from W/O to O/W by pouring a water medium (W phase) to form a discontinuous phase, thereby dispersing the resin in the form of particles in the water medium.

The volume-average particle diameter of the resin particles dispersed in the resin particle dispersion is, for example, preferably 0.01 μm or more and 1 μm or less, more preferably 0.08 μm or more and 0.8 μm or less, and still more preferably 0.1 μm or more and 0.6 μm or less.

The volume-average particle diameter of the resin particles is determined by using a particle size distribution obtained by measurement using a laser diffraction particle size distribution analyzer (for example, LA-700 manufactured by HORIBA, Ltd.). A volume-based cumulative distribution is formed from the smaller particle diameter side for the divided particle size ranges (channels), and the particle diameter at 50% of the volume of the whole particles is measured as the volume-average particle diameter D50v. The volume-average particle diameter of particles in any one of the other dispersions is measured by the same method.

The content of the resin particles contained in the resin particle dispersion is, for example, preferably 5% by mass or more and 50% by mass or less and more preferably 10% by mass or more and 40% by mass or less.

For example, the coloring agent particle dispersion and the release agent particle dispersion are prepared by the same method as for the resin particle dispersion. That is, the volume-average particle diameter, dispersion medium, dispersion method, and content of the particles in the resin particle dispersion are true for the coloring agent particles dispersed in the coloring agent particle dispersion and the release agent particles dispersed in the release agent particle dispersion.

—Formation of Aggregated Particles—

Next, the resin particle dispersion, the coloring agent particle dispersion, and the release agent particle dispersion are mixed together.

Then, the resin particles, the coloring agent particles, and the release agent particles are hetero-aggregated in the resultant mixed dispersion to form the aggregated particles having a diameter close to the diameter of the intended toner particles and containing the resin particles, the coloring agent particles, and the release agent particles.

Specifically, for example, an aggregating agent is added to the mixed dispersion and, at the same time, pH of the mixed dispersion is adjusted to an acidic value (for example, pH 2 or more and 5 or less) and, if required, a dispersion stabilizer is added. Then, the particles dispersed in the mixed dispersion are aggregated by heating the resultant mixture to a temperature (specifically, for example, (glass transition temperature of resin particles—30° C.) or more and (glass transition temperature of resin particles—10° C.) or less, which is close to the glass transition temperature of the resin particles, thereby forming the aggregated particles.

In forming the aggregated particles, the aggregating agent may be added at room temperature (for example, 25° C.) under stirring of the mixed dispersion by using a rotary shear homogenizer, then pH of the mixed dispersion may be adjusted to an acidic value (for example, pH 2 or more and 5 or less), and, if required, a dispersion stabilizer may be added before heating.

Examples of the aggregating agent include a surfactant with the polarity opposite to that of the surfactant contained as the dispersant in the mixed dispersion, inorganic metal salts, and di- or higher-valent metal complexes. When a metal complex is used as the aggregating agent, the amount of the surfactant used is decreased, and charging characteristics are improved.

If required, the aggregating agent may be used in combination with an additive which forms a complex or similar bond with the metal ion of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, aluminum sulfate, and the like; inorganic metal salt polymers such as aluminum polychloride, aluminum polyhydroxide, calcium polysulfide, and the like.

The chelating agent used may be a water-soluble chelating agent. Examples of the chelating agent include oxycarboxylic acids such as tartaric acid, citric acid, gluconic acid, and the like; imino-diacetic acid (IDA), nitrilotriacetic acid (NTA), ethylenediaminetetraacetic acid (EDTA), and the like.

The amount of the chelating agent added is, for example, preferably 0.01 parts by mass or more and 5.0 parts by mass or less and more preferably 0.1 parts by mass or more and less than 3.0 parts by mass relative to 100 parts by mass of the resin particles.

—Fusion-Coalescence—

Next, the aggregated particles are fused and coalesced by heating the aggregated particle dispersion in which the aggregated particles are dispersed to, for example, a temperature equal to or higher than the glass transition temperature of the resin particles (for example, 10° C. to 30° C. higher than the glass transition temperature of the resin particles), thereby forming the toner particles.

The toner particles are produced through the process described above.

The toner particles may be produced as follows. After the preparation of the aggregated particle dispersion in which the aggregated particles are dispersed, the aggregated particle dispersion is further mixed with the resin particle dispersion in which the resin particles are dispersed, and second aggregated particles are formed by aggregation so that the resin particles further adhere to the surfaces of the aggregated particles. Then, the second aggregated particles are fused and coalesced by heating the second aggregated particle dispersion, in which the second aggregated particles are dispersed, to form toner particles with a core-shell structure.

After fusion-coalescence is completed, dry toner particles are produced by a known method of washing, solid-liquid separation, and drying of the toner particles formed in the solution.

The washing is preferably performed by sufficient displacement washing with ion exchange water from the viewpoint of chargeability. The solid-liquid separation is not particularly limited but is preferably performed by suction filtration, pressure filtration, or the like from the viewpoint of productivity. The drying is not particularly limited but is preferably performed by freeze drying, flash drying, fluidized drying, vibration-type fluidized drying, or the like from the viewpoint of productivity.

Here, the toner particles containing the urea-modified polyester resin as the binder resin is preferably produced by a dissolution suspension method described below. In the description below of the dissolution suspension method, there is described a method for producing the toner particles containing the unmodified polyester resin and the urea-modified polyester resin as the binder resin. However, the toner particles may contain only the urea-modified polyester resin as the binder resin.

[Preparation of Oil-Phase Liquid]

An oil-phase liquid is prepared by dissolving or dispersing, in an organic solvent, toner particle materials containing an unmodified polyester resin, a polyester prepolymer having an isocyanate group, an amine compound, white particles or colored particles, and a release agent (preparation of an oil-phase liquid). In the preparation of the oil-phase liquid, a mixed solution of toner materials is prepared by dissolving or dispersing the toner particle materials in the organic solvent.

Examples of the method for preparing the oil-phase liquid include: 1) a method of dissolving or dispersing the toner materials in the organic solvent at a time; 2) a method of kneading in advance the toner materials and then dissolving or dispersing the resultant kneaded material in the organic solvent; 3) a method of dissolving the unmodified polyester resin, the polyester prepolymer having an isocyanate group, and the amine compound in the organic solvent and then dispersing the white particles or colored particles and the release agent in the organic solvent; 4) a method of dispersing the white particles or colored particles and the release agent in the organic solvent and then dissolving the unmodified polyester resin, the polyester prepolymer having an isocyanate group, and the amine compound in the organic solvent; 5) a method of dissolving or dispersing the toner particle materials (the unmodified polyester resin, the white particles or colored particles, and the release agent) other than the polyester prepolymer having an isocyanate group and the amine compound in the organic solvent and then dissolving the polyester prepolymer having an isocyanate group and the amine compound in the organic solvent; 6) a method of dissolving or dispersing the toner particle materials (the unmodified polyester resin, the white particles or colored particles, and the release agent) other than the polyester prepolymer having an isocyanate group or the amine compound in the organic solvent and then dissolving the polyester prepolymer having an isocyanate group or the amine compound in the organic solvent; and the like. The method for preparing the oil-phase liquid is not limited to these methods.

Examples of the organic solvent of the oil-phase liquid include ester solvents such as methyl acetate, ethyl acetate, and the like; ketone solvents such as methyl ethyl ketone, methyl isopropyl ketone, and the like; aliphatic hydrocarbon solvents such as hexane, cyclohexane, and the like; halogenated hydrocarbon solvents such as dichloromethane, chloroform, trichloroethylene, and the like; and the like. These organic solvents are preferably ones which dissolve the binder resin, are dissolved in water at a ratio of about 0% by mass or more and 30% by mass or less, and have a boiling point of 100° C. or less. Among these organic solvents, ethyl acetate is preferred.

[Preparation of Suspension]

Next, a suspension is prepared by dispersing the resultant oil-phase liquid in a water-phase liquid (preparation of a suspension).

At the same time as preparation of the suspension, the polyester prepolymer having an isocyanate group is reacted with the amine compound. This reaction produces the urea-modified polyester resin. The reaction is accompanied with at least one reaction of crosslinking reaction and extension reaction of a molecular chain. The reaction of the polyester prepolymer having an isocyanate group with the amine compound may be performed together with removal of the solvent described below.

The reaction conditions are selected according to the reactivity of the isocyanate group structure possessed by the polyester prepolymer with the amine compound. For example, the reaction time is preferably 10 minutes or more and 40 hours or less and more preferably 2 hours or more and 24 hours or less. The reaction temperature is preferably 0° C. or more and 150° C. or less and more preferably 40° C. or more and 98° C. or less. In addition, if required, the urea-modified polyester resin may be produced by using a known catalyst (dibutyltin laurate, dioctyltin laurate, or the like). That is, the catalyst may be added to the oil-phase liquid or the suspension.

The water-phase liquid is produced by, for example, dispersing a particle dispersant, such as an organic particle dispersant, an inorganic particle dispersant, or the like, in an aqueous solvent. Also, the water-phase liquid may be produced by dispersing the particle dispersant in an aqueous solvent and dissolving a polymer dispersant in the aqueous solvent. In addition, a known additive such as a surfactant or the like may be added to the water-phase liquid.

The aqueous solvent is, for example, water (generally, for example, ion exchange water, distilled water, or pure water). The aqueous solvent may be a solvent containing, together with water, an organic solvent such as an alcohol (methanol, isopropyl alcohol, ethylene glycol, or the like), dimethylformamide, tetrahydrofuran, cellosolve (methyl cellosolve the like), a lower ketone (acetone, methyl ethyl ketone, or the like).

The organic particle dispersant is, for example, a hydrophilic organic particle dispersant. Examples of the organic particle dispersant include particles of poly(meth)acrylic acid alkyl ester resins (for example, a polymethyl methacrylate and the like), a polystyrene resin, a poly(styrene-acrylonitrile) resin, and the like. The organic particle dispersant may be particles of a styrene-acrylic resin.

The inorganic particle dispersant is, for example, a hydrophilic inorganic particle dispersant. Examples of the inorganic particle dispersant include particles of silica, alumina, titania, calcium carbonate, magnesium carbonate, tricalcium phosphate, clay, diatomaceous earth, bentonite, and the like. Particles of calcium carbonate are preferred. These inorganic particle dispersants may be used alone or in combination of two or more.

The particle dispersant may be surface-treated with a polymer having a carboxyl group.

The polymer having a carboxyl group is, for example, a copolymer of α,β-monoethylenically unsaturated carboxylic acid ester with at least one selected from salts (an alkali metal salt, an alkaline-earth metal salt, an ammonium salt, an amine salt, and the like), which are produced by neutralizing α,β-monoethylenically unsaturated carboxylic acid or a carboxyl group of α,β-monoethylenically unsaturated carboxylic acid with an alkali metal, an alkaline earth metal, ammonia, amine, or the like. The polymer having a carboxyl group may be a salt (an alkali metal salt, an alkaline-earth metal salt, an ammonium salt, an amine salt, or the like), which is produced by neutralizing a carboxyl group of a copolymer of α,β-monoethylenically unsaturated carboxylic acid with α,β-monoethylenically unsaturated carboxylic acid ester, with an alkali metal, an alkaline earth metal, ammonia, amine, or the like. These polymers having a carboxyl group may be used alone or in combination of two or more.

Typical examples of the α,β-monoethylenically unsaturated carboxylic acid include α,β-unsaturated monocarboxylic acids (acrylic acid, methacrylic acid, crotonic acid, and the like), α,β-unsaturated dicarboxylic acids (maleic acid, fumaric acid, itaconic acid, and the like), and the like. Typical examples of the α,β-monoethylenically unsaturated carboxylic acid ester include (meth)acrylic acid alkyl esters, (meth)acrylates having an alkoxy group, (meth)acrylates having a cyclohexyl group, (meth)acrylates having a hydroxyl group, polyalkylene glycol mono(meth)acrylates, and the like.

The polymer dispersant is, for example, a hydrophilic polymer dispersant. Specific examples of the polymer dispersant include polymer dispersants (for example, water-soluble cellulose esters such as carboxymethyl cellulose, carboxyethyl cellulose, and the like) each having a carboxyl group but not having a lipophilic group (a hydroxypropoxy group, a methoxy group, or the like).

[Removal of Solvent]

Next, a toner particle dispersion is prepared by removing the organic solvent from the resultant suspension (removal of the solvent). In the removal of the solvent, the toner particles are produced by removing the organic solvent contained in the water-phase liquid droplets dispersed in the suspension. The organic solvent may be removed from the suspension immediately after the preparation of the suspension or after the passage of 1 minute or more from the preparation of the suspension.

In the removal of the solvent, the organic solvent is preferably removed from the suspension by cooling or heating the suspension, for example, within a range of 0° C. or more and 100° C. or less.

Examples of the method for removing the organic solvent include the following methods.

(1) A method of forcedly renewing the gas phase on the suspension surface by spraying an air stream on the suspension. In this method, a gas may be brown into the suspension.

(2) A method of reducing the pressure. In this method, the gas phase on the suspension surface may be forcedly renewed by filling a gas and a gas may be further brown into the suspension.

The toner particles are produced through the process described above.

After the removal of the solvent is completed, dry toner particles are produced by a known method of washing, solid-liquid separation, and drying of the toner particles formed in the toner particle dispersion.

The washing is preferably performed by sufficient displacement washing with ion exchange water from the viewpoint of chargeability.

The solid-liquid separation is not particularly limited but is preferably performed by suction filtration, pressure filtration, or the like from the viewpoint of productivity. The drying is not particularly limited but is preferably performed by freeze drying, flash drying, fluidized drying, vibration-type fluidized drying, or the like from the viewpoint of productivity.

The toner according to the exemplary embodiment of the present invention is produced by, for example, adding and mixing the external additives with the dry toner particles. Mixing may be performed by, for example, a V blender, a Henschel mixer, a Loedige mixer, or the like. Further, if required, coarse toner particles may be removed by using a vibrating sieve machine, an air sieve machine, or the like.

<Electrostatic Image Developer>

An electrostatic image developer according to an exemplary embodiment of the present invention contains at least the white toner according to the exemplary embodiment of the present invention.

The electrostatic image developer according to the exemplary embodiment may be a one-component developer containing only the white toner according to the exemplary embodiment or a two-component developer including a mixture of the white toner and a carrier.

The carrier is not particularly limited, and a known carrier can be used. Examples of the carrier include a coated carrier which contains a core material including a magnetic powder and having a resin-coated surface; a magnetic powder-dispersed carrier which contains a magnetic powder mixed and dispersed in a matrix resin; a resin-impregnated carrier which contains a porous magnetic powder impregnated with a resin; and the like.

The magnetic powder-dispersed carrier and the resin-impregnated carrier may be a carrier which contains the constituent particles of the carrier as a core material and a coating resin on the surface of the core material.

Examples of the magnetic powder include powders of magnetic metals such as iron, nickel, cobalt, and the like; magnetic oxides such as ferrite, magnetite, and the like; and the like.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid ester copolymer, a straight silicone resin containing an organosiloxane bond or modified products thereof, a fluorocarbon resin, polyester, polycarbonate, a phenol resin, an epoxy resin, and the like.

The coating resin and matrix resin may contain other additives such as conductive particles and the like.

Examples of the conductive particles include particles of metals such as gold, silver, copper, and the like, carbon black, titanium oxide, zinc oxide, tin oxide, barium sulfate, aluminum borate, potassium titanate, and the like.

The surface of the core material can be coated with the resin by, for example, a method of coating with a solution for forming a coating layer, which is prepared by dissolving the coating resin and various additives (used according to demand) in a proper solvent. The solvent is not particularly limited and may be selected in view of the type of the coating resin used, coatability, etc.

Examples of a resin coating method include a dipping method of dipping the core material in the solution for forming a coating layer; a spray method of spraying the solution for forming a coating layer on the surface of the core material; a fluidized bed method of spraying the solution for forming a coating layer on the core material in a state of being floated by fluidized air; a kneader/coater method of mixing the core material of the carrier with the solution for forming a coating layer in a kneader/coater and then removing the solvent; and the like.

The mixing ratio (mass ratio) of the toner to the carrier in the two-component developer is preferably toner:carrier=1:100 to 30:100 and more preferably 3:100 to 20:100.

<Image Forming Apparatus/Image Forming Method>

An image forming apparatus and image forming method according an exemplary embodiment of the present invention are described.

The image forming apparatus according the exemplary embodiment includes a first image forming unit which houses an electrostatic image developer containing the white toner according to the exemplary embodiment and which forms a white toner image, a second image forming unit which houses an electrostatic image developer containing a colored toner and which forms a colored toner image, a transfer unit which transfers the white toner image and the colored toner image to the surface of a recording medium, and a fixing unit which fixes the white toner image and colored toner image transferred to the surface of the recording medium.

Each of the first image forming unit and the second image forming unit includes, for example, an image holding member, a charging unit which charges the surface of the image holding member, an electrostatic image forming unit which forms an electrostatic image on the charged surface of the image holding member, and a developing unit which houses an electrostatic image developer containing the white toner according to the exemplary embodiment or the colored toner and develops, as a toner image, the electrostatic image formed on the surface of the image holding member with the electrostatic image developer.

The recording medium is preferably a transparent recording medium such as a film, an OH sheet, or the like.

The transfer unit laminates and transfers the colored toner image and the white toner image in that order on the surface of the recording medium.

The image forming apparatus according to the exemplary embodiment can form a colored image with a little color difference between the front end and the rear end in the transport direction of a transparent recording medium.

The image forming apparatus according the exemplary embodiment performs an image forming method (the image forming method according to the exemplary embodiment) which includes forming as a first image a white toner image with the electrostatic image developer containing the white toner according to the exemplary embodiment, forming as a second image a colored toner image with an electrostatic image developer containing a colored toner, transferring the white toner image and the colored toner image to the surface of the recording medium, and fixing the white toner image and colored toner image transferred to the surface of the recording medium.

Each of the first image and the second image is formed by, for example, charging the surface of the image holding member, forming an electrostatic image on the charged surface of the image holding member, and developing, as a toner image, the electrostatic image formed on the surface of the image holding member with the electrostatic image developer containing the white toner according to the exemplary embodiment or the colored toner.

Examples of application of the image forming apparatus according to the exemplary embodiment include known image forming apparatuses such as an apparatus of a direct transfer system in which a toner image formed on the surface of an image holding member is transferred directly to a recording medium; an apparatus of an intermediate transfer system in which a toner image formed on the surface of an image holding member is first transferred to the surface of an intermediate transfer body and the toner image transferred to the surface of the intermediate transfer body is second transferred to the surface of a recording medium; an apparatus including a cleaning unit which cleans the surface of an image holding member after transfer of the toner image and before charging; an apparatus including an eliminating unit which eliminates electricity by applying eliminating light to the surface of an image holding member after transfer of the toner image and before charging; and the like.

When the image forming apparatus according to the exemplary embodiment is an apparatus of the intermediate transfer system, a configuration applied to the transfer unit includes, for example, an intermediate transfer body to the surface of which a toner image is transferred, a first transfer unit which first transfers the toner image formed on the surface of the image holding member to the surface of the intermediate transfer body, and a second transfer unit which second transfers the toner image transferred to the surface of the intermediate transfer body to the surface of the recording medium.

In the image forming apparatus according to the exemplary embodiment, for example, a part containing the developing unit may be a cartridge structure (process cartridge) detachable from the image forming apparatus. An example which is preferably used as the process cartridge is a process cartridge including the developing unit which houses the electrostatic image developer according to the exemplary embodiment.

The image forming apparatus according to the exemplary embodiment may be an image forming apparatus of a tandem system in which a first image forming unit that forms a white toner image and at least one second image forming unit that forms a colored toner image are arranged in parallel, or a monochrome image forming apparatus which forms only a white image. In the latter case, a white image is formed on a recording medium by the image forming apparatus according to the exemplary embodiment, and a colored image is formed on the recording medium by another image forming apparatus.

An example of the image forming apparatus according to the exemplary embodiment is described below, but the image forming apparatus is not limited to this example. In the description below, principal parts shown in the drawings are described, and other parts are not described.

FIG. 1 is a schematic configuration diagram showing the image forming apparatus according to the exemplary embodiment, which is an image forming apparatus of a quintuple-tandem intermediate transfer system.

In FIG. 1, image forming units 10W, 10Y, 10M, 10C, and 10K are arranged in order from the right side.

The image forming apparatus shown in FIG. 1 includes the image forming units 10W, 10Y, 10M, 10C, and 10K (image forming units) of an electrophotographic system which output images of the colors of white (W), yellow (Y), magenta (M), cyan (C), and black (K), respectively, based on color-separated image data. The image forming apparatus is a tandem-system image forming apparatus in which a first image forming unit (10W) and second image forming units (10Y, 10M, 10C, and 10K) are arranged in parallel. These image forming units (may be simply referred to as the "units" hereinafter) 10W, 10Y, 10M, 10C, and 10K are arranged in parallel at predetermined spaces in the horizontal direction. These units 10W, 10Y, 10M, 10C, and 10K may be process cartridges detachable from the image forming apparatus.

In addition, an intermediate transfer belt (an example of the intermediate transfer body) 20 is extended below the units 10W, 10Y, 10M, 10C, and 10K so as to pass through the units. The intermediate transfer belt 20 is provided to be wound on a drive roller 22, a support roller 23, and a counter roller 24, which are disposed in contact with the inner surface of the intermediate transfer belt 20, so that the intermediate transfer belt 20 moves in the direction from the unit 10W to the unit 10K. Further, an intermediate transfer body cleaning device 21 is provided on the image holding surface side of the intermediate transfer belt 20 so as to face the drive roller 22.

In addition, white, yellow, magenta, cyan, and black toners contained in toner cartridges 8W, 8Y, 8M, 8C, and 8K are supplied to developing devices (an example of the developing unit) 4W, 4Y, 4M, 4C, and 4K of the units 10W, 10Y, 10M, 10C, and 10K, respectively.

The units 10W, 10Y, 10M, 10C, and 10K have the same configuration and operation and thus the unit 10Y which forms a yellow image is described as a representative.

The unit 10Y has a photoreceptor 1Y functioning as the image holding member. Around the photoreceptor 1Y, there are sequentially provided a charging roller (an example of the charging unit) 2Y which charges the surface of the photoreceptor 1Y to a predetermined potential, an exposure device (an example of the electrostatic image forming unit) 3Y which forms an electrostatic image by exposure of the charged surface with a laser beam based on an image signal obtained by color separation, a developing device (an example of the developing unit) 4Y which develops the electrostatic image by supplying the toner to the electrostatic image, a first transfer roller (an example of the first transfer unit) 5Y which transfers the developed toner image to the intermediate transfer belt 20, and a photoreceptor cleaning device (an example of the cleaning unit) 6Y which removes the toner remaining on the surface of the photoreceptor 1Y after first transfer.

The first transfer roller 5Y is disposed on the inside of the intermediate transfer belt 20 and is provided at a position facing the photoreceptor 1Y. Further, a bias power supply (not shown) is connected to each of the first transfer rollers 5W, 5Y, 5M, 5C, and 5K of the respective units in order to apply a first transfer bias thereto. The value of transfer bias applied to each of the first transfer rollers from the bias power supply can be changed by control of a controller (not shown).

The operation of forming a yellow image in the unit 10Y is described below.

First, before the operation, the surface of the photoreceptor 1Y is charged to a potential of −600 V to −800 V by the charging roller 2Y.

The photoreceptor 1Y is formed by laminating a photosensitive layer on a conductive (for example, a volume resistivity of $1\times10^{-6}$ Ω·cm or less at 20° C.) substrate. The photosensitive layer generally has high resistance (the resistance of a general resin) and has the property that when irradiated with a laser beam, the resistivity of a portion irradiated with the laser beam is changed. Thus, the charged surface of the photoreceptor 1Y is irradiated with a laser beam from the exposure device 3Y according to yellow image data sent from the controller (not shown). Therefore, an electrostatic image in a yellow image pattern is formed on the surface of the photoreceptor 1Y.

The electrostatic image is an image formed on the surface of the photoreceptor 1Y by charging and is a so-called negative latent image formed by the laser beam from the exposure device 3Y, which causes the electrostatic charge flowing in the surface of the photoreceptor 1Y due to a decrease in resistivity of the irradiated portion of the photosensitive layer while the charge in a portion not irradiated with the laser beam remains.

The electrostatic image formed on the photoreceptor 1Y is rotated to a predetermined development position with travel of the photoreceptor 1Y. Then, at the development position, the electrostatic image on the photoreceptor 1Y is visualized as a toner image by the developing device 4Y.

For example, the electrostatic image developer containing at least the yellow toner and the carrier is housed in the developing device 4Y. The yellow toner is frictionally charged by stirring in the developing device 4Y and thus has a charge with the same polarity (negative polarity) as that of the electrostatic charge on the photoreceptor 1Y and is held on the developer roller (an example of the developer holding body). When the surface of the photoreceptor 1Y is passed through the developing device 4Y, the yellow toner electrostatically adheres to an electrostatically eliminated latent image on the surface of the photoreceptor 1Y, developing the latent image with the yellow toner. Then, the photoreceptor 1Y on which the yellow toner image has been formed is continuously traveled at a predetermined speed, and the toner image developed on the photoreceptor 1Y is transported to a predetermined first transfer position.

When the yellow toner image on the photoreceptor 1Y is transported to the first transfer position, the first transfer bias is applied to the first transfer roller 5Y, and electrostatic force to the first transfer roller 5Y from the photoreceptor 1Y is applied to the toner image. Thus, the toner image on the photoreceptor 1Y is transferred to the intermediate transfer belt 20. The transfer bias applied has a polarity (+) opposite to the polarity (−) of the toner and is controlled in the first unit 10Y to, for example, +10 μA by the controller (not shown).

On the other hand, the toner remaining on the photoreceptor 1Y is removed by the photoreceptor cleaning device 6Y and recovered.

The first transfer bias applied to each of the first transfer rollers 5W, 5M, 5C, and 5K of the unit 10W and the later units is controlled according to the first unit 10Y.

Then, in the units 10W, 10M, 10C, and 10K, the toner images of the respective colors are superposed by multilayer transfer on the intermediate transfer belt 20 to which the yellow toner image has been transferred in the unit 10Y.

The intermediate transfer belt 20 to which the five color toner images have been transferred in multiple layers through the units is reached to a second transfer part configurated by the intermediate transfer belt 20, the counter roller 24 in contact with the inner side of the intermediate transfer belt 20, and the second transfer roller (an example of the second transfer unit) 26 disposed on the image holding surface side of the intermediate transfer belt 20. Meanwhile, recording paper (an example of the recording medium) P is fed with predetermined timing, through a feeding mechanism, to a space in which the second transfer roller 26 is in contact with the intermediate transfer belt 20, and a second transfer bias is applied to the counter roller 24. The applied transfer bias has the same polarity (−) as the polarity (−) of the toner and electrostatic force acting toward the recording paper P from the intermediate transfer belt 20 is applied to the toner image to transfer the toner image on the intermediate transfer belt 20 to the recording paper P. During the second transfer, the second transfer bias is determined according to the resistance detected by a resistance detecting unit (not shown) which detects the resistance of the second transfer part and is voltage-controlled.

Then, the recording paper P is transported to a pressure-contact part (nip part) of a pair of fixing rollers in the fixing device (an example of the fixing unit) 28, and the toner image is fixed to the recording paper P, forming a fixed image.

Examples of the recording paper P to which the toner image is transferred include plain paper used for an electrophotographic copying machine, a printer, and the like. Other than the recording paper P, an OHP sheet and the like can be used as the recording medium.

In order to further improve the smoothness of the image surface after fixing, the recording paper P has a smooth surface and, for example, coated paper formed by coating the surface of plain paper with a resin or the like, art paper for printing, or the like can be used.

The recording paper P after the completion of fixing of the color image is discharged to a discharge part, and a series of color image forming operations is finished.

<Process Cartridge and Toner Cartridge>

A process cartridge according to an exemplary embodiment of the present invention is described.

The process cartridge according to the exemplary embodiment is a process cartridge detachably mounted on the image forming apparatus and including a developing unit which houses the electrostatic image developer according to the exemplary embodiment and develops as the toner image the electrostatic image formed on the image holding member.

The process cartridge according to the exemplary embodiment may have a configuration including a developing unit and, if required, for example, at least one selected from other units such as an image holding member, a charging unit, an electrostatic image forming unit, and a transfer unit, etc.

An example of the process cartridge according to the exemplary embodiment is described below, but the process cartridge is not limited to this example. In the description below, principal parts shown in the drawings are described, but description of other parts is omitted.

Figure 2:
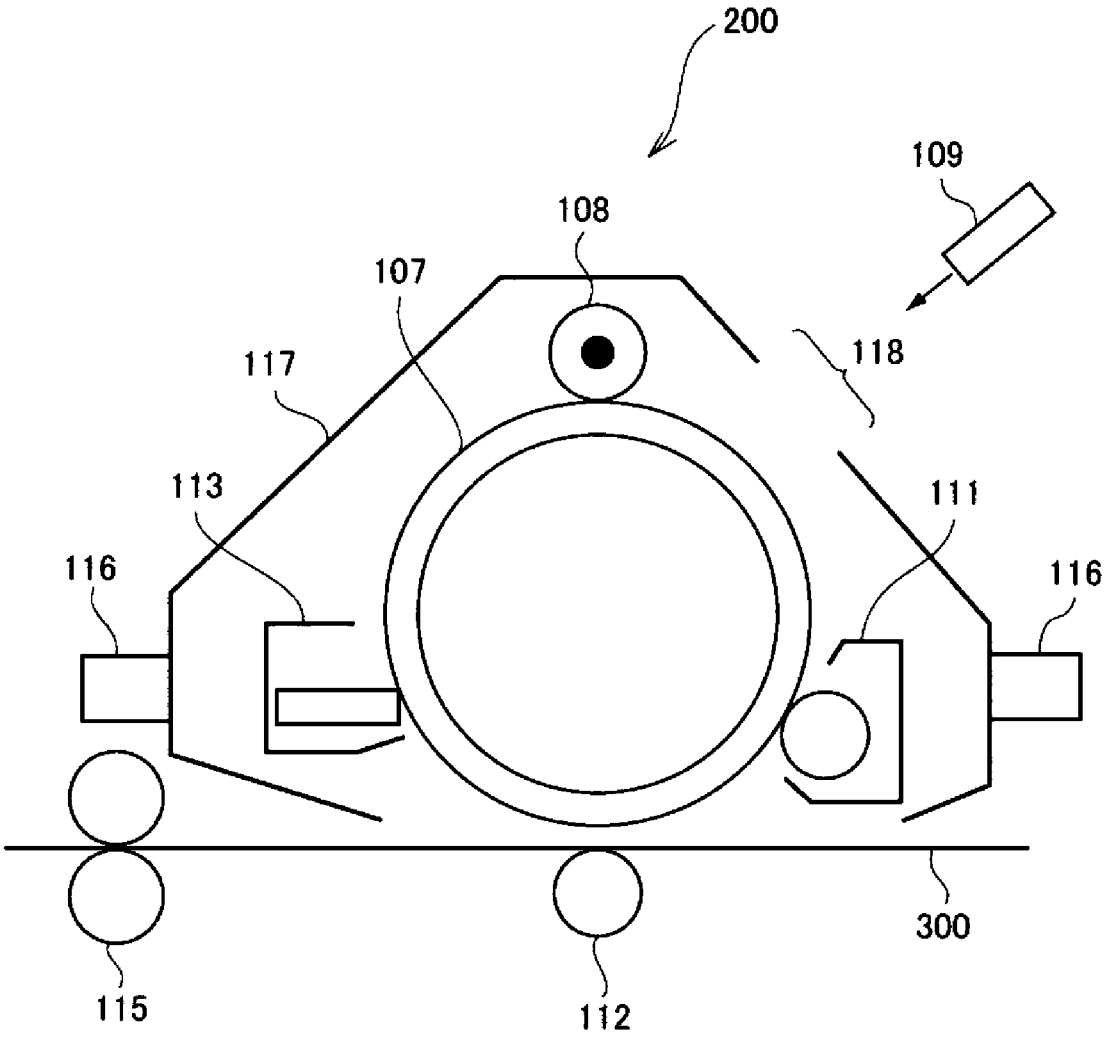
FIG. 2 is a schematic configuration diagram showing a process cartridge according to an exemplary embodiment of the present invention.

FIG. 2 is a schematic configuration diagram showing the process cartridge according to the exemplary embodiment.

A process cartridge 200 shown in FIG. 2 is a cartridge with a configuration in which a photoreceptor 107 (an example of the image holding member) and a charging roller 108 (an example of the charging unit), a developing device ill (an example of the developing unit), and a photoreceptor cleaning device 113 (an example of the cleaning unit), which are provided around the photoreceptor 107, are integrally held in combination by a housing 117 provided with a mounting rail 116 and an opening 118 for exposure.

In FIG. 2, reference numeral 109 denotes an exposure device (an example of the electrostatic image forming unit), reference numeral 112 denotes a transfer device (an example of the transfer unit), reference numeral 115 denotes a fixing device (an example of the fixing unit), and reference numeral 300 denotes recording paper (an example of the recording medium).

Next, a toner cartridge according to an exemplary embodiment of the present invention is described.

The toner cartridge according to the exemplary embodiment is a toner cartridge containing the white toner according to the exemplary embodiment and being detachable from the image forming apparatus. The toner cartridge is intended to contain the toner for replenishment to supply the toner to the developing unit provided in the image forming apparatus.

The image forming apparatus shown in FIG. 1 is an image forming apparatus having a configuration in which toner cartridges 8W, 8Y, 8M, 8C, and 8K are detachably provided. Each of developing units 4W, 4Y, 4M, 4C, and 4K is connected to the toner cartridge of the corresponding color through a toner supply tube (not shown). Also, when the amount of the toner contained in the toner cartridge is decreased, the toner cartridge is exchanged. An example of the toner cartridge according to the exemplary embodiment is the toner cartridge 8W and houses the white toner according to the exemplary embodiment. The yellow, magenta, cyan, and black toners are housed in the toner cartridges 8Y, 8M, 8C, and 8K, respectively.

EXAMPLES

Exemplary embodiments of the present invention are described in further detail below by giving examples and comparative examples, but the exemplary embodiments are not limited to these examples. In the description below, "parts" and "%" are on a mass basis unless particularly specified.

(Synthesis of Crystalline Polyester Resin and Preparation of Particle Dispersion Thereof)

In a three-neck flask dried by heating, 266 parts of 1,10-decanedicarboxylic acid, 169 parts of 1,6-hexanediol, and 0.035 parts of tetrabutoxytitanate as a catalyst are placed, and then the pressure of air in the vessel is reduced by a pressure reducing operation. Further, an inert atmosphere is created by nitrogen gas, and then the resultant mixture is refluxed under mechanical stirring at 180° C. for 6 hours. Then, the temperature is gradually increased to 220° C. by reduced-pressure evaporation, followed by stirring for 2.5 hours. When the mixture becomes a viscous state, the resin acid value is measured. When the resin acid value is 15.0 mgKOH/g, the reduced-pressure evaporation is stopped, and air cooling is performed to produce a crystalline polyester resin.

As a result of measurement of the weight-average molecular weight (Mw) of the resultant crystalline polyester resin by the method described above, the weight-average molecular weight is 13,000. Also, as a result of measurement of the melting temperature of the resultant crystalline polyester resin by using a differential scanning calorimeter (DSC), the melting temperature is 73° C.

Next, 180 parts of the crystalline polyester resin and 585 parts of ion exchange water are placed in a stainless beaker, which is then immersed in a hot bath and heated to 95° C. When the crystalline polyester resin is molten, the molten resin is stirred at 8000 rpm by using a homogenizer (Ultra-Turrax T50, manufactured by IKA Corporation). At the same time, pH is adjusted to 7.0 by adding dilute ammonia water. Then, emulsification dispersion is performed while adding dropwise 20 parts of an aqueous solution in which 0.8 parts of an anionic surfactant (Neogen R manufactured by Daiichi Kogyo Seiyaku Co., Ltd.) is diluted, thereby preparing a crystalline polyester resin particle dispersion (resin particle concentration: 40% by mass) having a volume-average particle diameter of 0.18 μm.

(Synthesis of Amorphous Polyester Resin and Preparation of Particle Dispersion Thereof)

In a two-neck flask dried by heating, 74 parts of dimethyl adipate, 192 parts of dimethyl terephthalate, 216 parts of bisphenol A ethylene oxide adduct, 38 parts of ethylene glycol, and 0.037 parts of tetrabutoxytitanate as a catalyst are placed, maintained in an inert atmosphere by introducing nitrogen gas into the vessel, and heated under stirring. Then, co-polycondensation reaction is performed at 160° C. for about 7 hours, and then the temperature is increased to 220° C. while gradually decreasing the pressure to 10 Torr and maintained for 4 hours. Once the pressure is returned to normal pressure, and 9 parts of trimellitic anhydride is added. The pressure is again gradually decreased to 10 Torr and maintained for 1 hour, synthesizing an amorphous polyester resin.

As a result of measurement of the glass transition temperature of the resultant amorphous polyester resin by the measurement method described above using a differential scanning calorimeter (DSC), the glass transition temperature is 60° C. As a result of measurement of the molecular weight of the resultant amorphous polyester resin by the measurement method described above using GPC, the weight-average molecular weight (Mw) is 12,000. Also, as a result of measurement of the acid value of the resultant amorphous polyester resin, the acid value is 25.0 mgKOH/g.

Next, 115 parts of the amorphous polyester resin, 180 parts of deionized water, and 5 parts of an anionic surfactant (Neogen R manufactured by Daiichi Kogyo Seiyaku Co., Ltd.) are mixed, heated to 120° C., and then sufficiently dispersed by using a homogenizer (Ultra-Turrax T50, manufactured by IKA Corporation). Then, the resultant mixture is dispersed for 1 hour by using a pressure discharge-type Gorlin homogenizer, thereby preparing an amorphous polyester resin particle dispersion (resin particle concentration: 40% by mass).

(Preparation of White Coloring Agent Dispersion)

White pigment (titanium oxide, CR-60-2 manufactured by Ishihara Sangyo Kaisha, Ltd.) . . . 100 parts Anionic surfactant (Neogen R manufactured by Daiichi Kogyo Seiyaku Co., Ltd., 20% aqueous solution) . . . 15 parts Ion exchange water . . . 400 parts These components are mixed by using a stirrer to prepare a white coloring agent dispersion. As a result of measurement of the volume-average particle diameter of the coloring agent (titanium oxide) in the resultant white coloring agent dispersion by using a laser diffraction particle size distribution analyzer, the volume-average particle diameter is 0.6 μm. In addition, the solid content ratio of the white coloring agent dispersion is 23% by mass. (Preparation of release agent particle dispersion (1))

Release agent (carnauba wax RC-160 manufactured by Toa Kasei Co., Ltd., melting temperature: 84° C.) . . . 90 parts Anionic surfactant (Neogen R, manufactured by Daiichi Kogyo Seiyaku Co., Ltd, 20% aqueous solution) . . . 3.6 parts Ion exchange water . . . 360 parts These components are mixed and heated to 100° C., and the mixture is dispersed by using a pressure discharge-type Gorlin homogenizer, thereby preparing a release agent particle dispersion (1). As a result of measurement of the volume-average particle diameter of the release agent in the resultant release agent particle dispersion by using a laser diffraction particle size distribution analyzer, the volume-average particle diameter is 0.25 μm. In addition, the solid content ratio of the release agent particle dispersion (1) is 20% by mass.

(Formation of White Toner)

<Preparation of White Toner 1>

Crystalline polyester resin particle dispersion . . . 80 parts

Amorphous polyester resin particle dispersion . . . 265 parts

White coloring agent dispersion . . . 522 parts

Release agent particle dispersion (1) . . . 98 parts

Ion exchange water . . . 500 parts

The components described above are added to a cylindrical stainless vessel and dispersed for 1 minute by using a homogenizer (Ultra-Turrax T50, manufactured by IKA Corporation). Next, 1.5 parts by mass of a 1 mass aqueous solution of aluminum sulfate as an aggregating agent is added dropwise to the resultant mixture and further dispersed and mixed for 5 minutes to prepare an aggregated slurry. Next, a stirrer and a thermometer are installed in the vessel, and the temperature is gradually increased by a mantle heater while continuing moderate stirring and then maintained at 45° C. for 1 hour. Then, 56 parts of the amorphous polyester resin particle dispersion is added, and the resultant mixture is heated to 50° C. to adhere the resin particles to the surfaces of the aggregated particles. After confirming by an optical microscope that the thickness of the resin coating later is increased, pH of the aggregated particle slurry is adjusted to 8.0, heated to 80° C., maintained for an appropriate time while confirming the degree of coalescence by the optical microscope, and then cooled.

After coarse particles are removed from the resultant toner slurry by using a nylon net, the residue is filtered, cake-washed with ion exchange water, and then dried with a vacuum dryer for 12 hours to produce toner particles 1 having a toner particle diameter of 8.3 μm.

Then, 100 parts of the toner particles 1 and, as an external additive, 0.3 parts of hydrophobic silica RX50 manufactured by Nippon Aerosil Co., Ltd. and 1.0 parts of hydrophobic silica R972 manufactured by Nippon Aerosil Co., Ltd. are blended by using a Henschel mixer for 15 minutes at a peripheral speed of 20 m/s. Then, coarse particles are removed by using a sieve with a mesh of 45 μm to produce a white toner 1.

<Preparation of White Toner 2>

A white toner 2 is produced by the same method as for the white toner 1 except that 60 parts of the crystalline polyester resin particle dispersion and 285 parts of the amorphous polyester resin particle dispersion are initially added.

<Preparation of White Toner 3>

A white toner 3 is produced by the same method as for the white toner 1 except that 37 parts of the crystalline polyester resin particle dispersion and 308 parts of the amorphous polyester resin particle dispersion are initially added.

<Preparation of White Toner 4>

A white toner 4 is produced by the same method as for the white toner 1 except that 112 parts of the crystalline polyester resin particle dispersion and 233 parts of the amorphous polyester resin particle dispersion are initially added.

<Preparation of White Toner 5>

A white toner 5 is produced by the same method as for the white toner 1 except that 180 parts of the crystalline polyester resin particle dispersion and 165 parts of the amorphous polyester resin particle dispersion are initially added.

<Preparation of White Toner 6>

A white toner 6 is produced by the same method as for the white toner 1 except that 38 parts of the amorphous polyester resin particle dispersion is added after heating and maintaining.

<Preparation of White Toner 7>

A white toner 7 is produced by the same method as for the white toner 1 except that 19 parts of the amorphous polyester resin particle dispersion is added after heating and maintaining.

<Preparation of White Toner 8>

A white toner 8 is produced by the same method as for the white toner 1 except that 38 parts of the crystalline polyester resin particle dispersion and 345 parts of the amorphous polyester resin particle dispersion are initially added, and 19 parts of the amorphous polyester resin particle dispersion is added after heating and maintaining.

<Preparation of White Toner 9>

A white toner 9 is produced by the same method as for the white toner 1 except that 94 parts of the amorphous polyester resin particle dispersion is added after heating and maintaining.

<Preparation of White Toner 10>

A white toner 10 is produced by the same method as for the white toner 1 except that 38 parts of the crystalline polyester resin particle dispersion and 270 parts of the amorphous polyester resin particle dispersion are initially added to, and 94 parts of the amorphous polyester resin particle dispersion is added after heating and maintaining.

<Preparation of White Toner 11>

A white toner 11 is produced by the same method as for the white toner 1 except that 113 parts of the crystalline polyester resin particle dispersion and 270 parts of the amorphous polyester resin particle dispersion are initially added, and 19 parts of the amorphous polyester resin particle dispersion is added after heating and maintaining.

<Preparation of White Toner 12>

A white toner 12 is produced by the same method as for the white toner 1 except that 113 parts of the crystalline polyester resin particle dispersion and 195 parts of the amorphous polyester resin particle dispersion are initially added, and 94 parts of the amorphous polyester resin particle dispersion is added after heating and maintaining.

<Preparation of White Toner 13>

A white toner 13 is produced by the same method as for the white toner 1 except that 276 parts of the amorphous polyester resin particle dispersion and 75 parts of the release agent particle dispersion (1) are initially added.

<Preparation of White Toner 14>

A white toner 14 is produced by the same method as for the white toner 1 except that 287 parts of the amorphous polyester resin particle dispersion and 53 parts of the release agent particle dispersion (1) are initially added.

<Preparation of White Toner 15>

A white toner 15 is produced by the same method as for the white toner 1 except that 254 parts of the amorphous polyester resin particle dispersion and 120 parts of the release agent particle dispersion (1) are initially added.

<Preparation of White Toner 16>

A white toner 16 is produced by the same method as for the white toner 1 except that 242 parts of the amorphous polyester resin particle dispersion and 143 parts of the release agent particle dispersion (1) are initially added.

<Preparation of White Toner 17>

A white toner 17 is produced by the same method as for the white toner 1 except that 30 parts of the crystalline polyester resin particle dispersion and 315 parts of the amorphous polyester resin particle dispersion are initially added.

<Preparation of White Toner 18>

A white toner 18 is produced by the same method as for the white toner 1 except that 190 parts of the crystalline polyester resin particle dispersion and 155 parts of the amorphous polyester resin particle dispersion are initially added.

<Preparation of White Toner 19>

A white toner 19 is produced by the same method as for the white toner 1 except that 113 parts of the crystalline polyester resin particle dispersion and 279 parts of the amorphous polyester resin particle dispersion are initially added, and 9 parts of the amorphous polyester resin particle dispersion is added after heating and maintaining.

<Preparation of White Toner 20>

A white toner 20 is produced by the same method as for the white toner 1 except that 113 parts of the crystalline polyester resin particle dispersion and 176 parts of the amorphous polyester resin particle dispersion are initially added, and 113 parts of the amorphous polyester resin particle dispersion is added after heating and maintaining.

<Preparation of White Toner 21>

A white toner 21 is produced by the same method as for the white toner 1 except that 38 parts of the crystalline polyester resin particle dispersion and 332 parts of the amorphous polyester resin particle dispersion are initially added, and 9 parts of the amorphous polyester resin particle dispersion is added after heating and maintaining.

<Preparation of White Toner 22>

A white toner 22 is produced by the same method as for the white toner 1 except that 38 parts of the crystalline polyester resin particle dispersion and 251 parts of the amorphous polyester resin particle dispersion are initially added, and 113 parts of the amorphous polyester resin particle dispersion is added after heating and maintaining.

<Preparation of White Toner 23 containing urea-modified polyester resin>

(Synthesis of Crystalline Polyester Resin (1))

In a flask having an inner capacity of 5 liters and provided with a stirrer, a nitrogen inlet tube, a temperature sensor, and a rectifying column, 80.9 parts of fumaric acid, 46.3 parts of 1,10-decanediol, and 1 part of titanium tetraethoxide relative to 100 parts of the materials described above (fumaric acid and 1,10-decanediol) are added. Then, reaction is performed at 150° C. for 4 hours while the produced water is removed, and then the temperature is increased to 180° C. over 6 hours in a nitrogen stream, followed by reaction at 180° C. for 6 hours. Then, reaction is performed for 1 hour under reduced pressure, and the reaction product is cooled to produce an unmodified crystalline polyester resin (1).

(Preparation of Unmodified Polyester Resin (1))

Terephthalic acid: 1243 parts

Bisphenol A ethylene oxide adduct: 1800 parts

Bisphenol A propylene oxide adduct: 800 parts

These components are heated and mixed at 185° C., and then 2.5 parts of dibutyltin oxide is added to the mixture. Then, water is distilled off under heating at 225° C., thereby producing an unmodified polyester resin (1).

(Preparation of Polyester Prepolymer (1))

Terephthalic acid: 1255 parts

Bisphenol A ethylene oxide adduct: 1845 parts

Bisphenol A propylene oxide adduct: 850 parts

These components are heated and mixed at 180° C., and then 2.5 parts of dibutyltin oxide is added to the resultant mixture. Then, water is distilled off under heating at 225° C., thereby producing a polyester. In a vessel, 350 parts of the resultant polyester, 55 parts of tolylene diisocyanate, and 500 parts of ethyl acetate are placed, and the resultant mixture is heated at 120° C. for 5 hours to produce a polyester prepolymer (1) having an isocyanate group (hereinafter referred to as an isocyanate-modified polyester prepolymer (1)").

(Preparation of Ketimine Compound (1))

In a vessel, 60 parts of methyl ethyl ketone and 155 parts of hexamethylenediamine are placed and stirred at 65° C. to prepare a ketamine compound (1).

(Production of White Colored Particles (1))

First, 100 parts of white pigment (titanium oxide, CR-60-2 manufactured by Ishihara Sangyo Kaisha, Ltd.)

and 200 parts of ion exchange water adjusted to pH4 by using a 0.1N hydrogen chloride solution are mixed, dispersed overnight by using a ball mill, and then allowed to stand. The supernatant is removed, and then the residue is dried by using a freeze vacuum dryer for 12 hours, crushed by a jet mill, and then sieved to remove coarse particles, thereby producing white colored particles (1) containing 18% by number of white colored particles having a number-average particle diameter of 280 nm and a particle diameter of 350 nm or more and 600 nm or less.

(Preparation of White Colored Particle Dispersion (11))

White colored particles (1): 100 parts

Ethyl acetate: 500 parts

These components are mixed, and the operation of filtering the resultant mixture and further mixing with 500 parts of ethyl acetate is repeated 5 times. Then, the mixture is dispersed for about 1 hour by using emulsification disperser Cavitron (CR1010 manufactured by Pacific Machinery & Engineering Co., Ltd.), thereby producing a white colored particle dispersion (11) (solid content concentration: 10%).

(Preparation of Release Agent Particle Dispersion (2))

Release agent (carnauba wax RC-160 manufactured by Toakasei Co., Ltd., melting temperature: 84° C.): 30 parts Ethyl acetate: 270 parts These components are wet-ground by using a microbeads disperser (DCP mill) in a state of being cooled at 10° C., producing a release agent particle dispersion (2) (solid content concentration: 10%).

(Preparation of Oil-Phase Liquid (1))

Unmodified polyester resin (1): 136 parts

White colored particle dispersion (11): 1260 parts

Ethyl acetate: 56 parts

These components are stirred and mixed, and then 200 parts of the release agent particle dispersion (2) is added to the resultant mixture and stirred, thereby preparing an oil-phase liquid (1).

(Preparation of Styrene-Acrylic Resin Particle Dispersion (1))

Styrene: 400 parts n-Butyl acrylate: 30 parts

Acrylic acid: 4 parts

Dodecanethiol: 25 parts

Carbon tetrabromide: 5 parts

These components are mixed and dissolved, and the dissolved mixture is emulsified, in a flask, in an aqueous solution prepared by dissolving 5 parts of a nonionic surfactant (Nonipol 400 manufactured by Sanyo Chemical Industries, Ltd.) and 10 parts of an anionic surfactant (Neogen SC manufactured by Daiichi Kogyo Seiyaku Co., Ltd.) in 560 parts of ion exchange water. Then, an aqueous solution prepared by dissolving 4 parts of ammonium persulfate in 50 parts of ion exchange water is added under mixing for 10 minutes to the flask, which is then purged with nitrogen. Then, the contents in the flask are heated to 70° C. by an oil bath under stirring, and, in this state, emulsion polymerization is continued for 5 hours, thereby producing a styrene-acrylic resin particle dispersion (1) (solid content concentration: 40%) in which the resin particles are dispersed.

(Preparation of Water-Phase Liquid (1))

Styrene-acrylic resin particle dispersion (1): 60 parts

2% aqueous solution of Serogen BS-H (manufactured by Daiichi Kogyo Seiyaku Co., Ltd.): 200 parts Ion exchange water: 200 parts These components are stirred and mixed to prepare a water-phase liquid (1).

(Preparation of Toner Particles 23)

Crystalline polyester resin (1): 15 parts

Oil-phase liquid (1): 300 parts

Isocyanate-modified polyester prepolymer (1): 25 parts

Ketimine compound (1): 1.5 parts

Among these components, 15 parts of the crystalline polyester resin (1) is dissolved in 300 parts of the oil-phase liquid (1). Then, the residual components are added to a vessel, and the resultant mixture is stirred for 2 minutes by using a homogenizer (Ultra-Turrax, manufactured by IKA Corporation) to prepare an oil-phase liquid (1P). Then, 1000 parts of the water-phase liquid (1) is added to the vessel and stirred for 20 minutes by using a homogenizer. Next, the resultant mixture is stirred for 48 hours by using a propeller-type stirrer at room temperature (25° C.) and normal pressure (1 atom), and thereby the isocyanate-modified polyester prepolymer (1) is reacted with the ketamine compound (1). Consequently, a urea-modified polyester resin is produced, and the organic solvent is removed to form particle-like material. Next, the particle-like material is washed with water, dried, and then classified to produce toner particles 23 having a toner particle diameter of 8.2 μm.

A white toner 23 is produced by the same method as for preparing the white toner 1 except that the toner particles 23 are used in place of the toner particles 1.

<Preparation of White Toner 24 Containing styrene-(meth) acrylic Resin>

(Preparation of Styrene-Acrylic Resin Dispersion)

A solution of a mixture of 370 g of styrene, 30 g of n-butyl acrylate, 8 g of acrylic acid, 24 g of dodecanethiol, and 4 g of carbon tetrabromide is emulsion-polymerized in a flask in which 6 g of a nonionic surfactant (Nonipol 400 manufactured by Sanyo Chemical Industries, Ltd.) and 10 g of an anionic surfactant (Neogen SC manufactured by Daiichi Kogyo Seiyaku Co., Ltd.) are dissolved in 550 g of ion exchange water. Then, under slow mixing for 10 minutes, 50 g of ion exchange water in which 4 g of ammonium persulfate is dissolved is added to the flask, which is then purged with nitrogen. Then, the contents in the flask are heated to 70° C. in an oil bath under stirring, and, in this state, emulsion polymerization is continued for 5 hours, thereby producing a styrene-acrylic resin dispersion having a volume-average particle diameter of 150 nm and a solid content concentration of 40%. The resultant styrene-acrylic resin dispersion is dried to produce a resin having a weight-average molecular weight of 11,500, a glass transition temperature of 58° C., and a resin specific gravity of 1.0 g/cm$^3$.

(Production of Toner Particles 24)

A white toner 24 is produced by the same method as for preparing the white toner 1 except that in place of the amorphous polyester resin particle dispersion, the styrene-acrylic resin dispersion is added initially and after heating and maintaining.

(Production of Developer)

First, 1.25 parts of toluene is mixed with 0.12 parts of carbon black (trade name, VXC-72 manufactured by Cabot Corporation) and stirred and dispersed for 20 minutes by using a sand mill to prepare a carbon dispersion. The resultant carbon dispersion is mixed and stirred with 1.20 parts of a 80% ethyl acetate solution of trifunctional isocyanate (Takenate D110N manufactured by Takeda Chemical Industries, Ltd.), thereby preparing a coating agent resin solution. The coating agent resin solution and Mn—Mg—Sr ferrite particles (volume-average particle diameter: 35 μm) are added to a kneader and mixed and stirred for 5 minutes at room temperature. Then, the solvent is distilled off by heating to 150° C. at normal pressure. After further mixing and stirring for 30 minutes, the power supply of a heater is turned off to decrease the temperature to 50° C. under stirring. The resultant coated carrier is sieved with a mesh of 75 μm, forming a carrier.

Then, 95 parts of the carrier is mixed with 8 parts of each of the toners by using a V-blender to produce a developer of white color.

Examples 1 to 21 and Comparative Examples 1 to 3

The white toners produced are used as toners of Examples 1 to 21 and Comparative Examples 1 to 3 as shown in Table 1. Evaluation described below is carried out by using the developer containing each of the toners. The evaluation is carried out in an environment at a temperature of 25° C. and a humidity of 30% RH.

<Evaluation of Toner Viscosity Behavior>

The viscosity behavior of each of the toners is confirmed by the "temperature-viscosity curve" of each of the toners, which is formed by measuring the melt viscosity using a flow tester (CFT-500 manufactured by Shimadzu Corporation) and 1 g of the toner under the conditions in which the test pressure is 10 kgf/cm$^2$, the heating rate is 1 C/min, the preheating time is 300 seconds, the start temperature is 70° C., the central hole diameter of a sample table is 0.5 mm, and the hole thickness (length) is 1 mm.

When the temperature-viscosity curve has a minimum value within the temperature range of 70° C. or more and 95° C. or less, the minimum value is evaluated as "Yes". When a peak (valley) is not observed in the temperature-viscosity curve or when a peak is observed but the minimum value is not observed within the temperature range, the minimum value is evaluated as "No". The results of evaluation are shown in Table 1.

<Evaluation of Color Difference of Colored Image>

The color difference of a colored image is evaluated by observing a color difference between the front end and the rear end in the transport direction of a transparent recording medium using a modified machine of Color Press 1000i manufactured by Fuji Xerox Co., Ltd. The specific evaluation method is as follows.

By using each of the resultant white toners and YMCK toners installed in Color 1000i Press manufactured by Fuji Xerox Co., Ltd., an image of a size of 100 mm×100 mm is formed on an OHP film for PPC laser with the YMCK toner applied amount adjusted to 8.0 g/m$^2$ and the upper layer white toner applied amount adjusted to 8.0 g/m$^2$. The fixing conditions include a fixing rate of 400 mm/sec and a fixing temperature of 160° C., and 100 sheets are continuously output.

With respect to the image on the 100th sheet, the L* value, a* value, and b* value are measured at each of the image ends on the front end side and the rear end side of the recording medium. The measurement is performed by using hiding rate test paper placed below the OHP film. Based on the measurement results, a color difference $\Delta E_{AB}$ is calculated by a formula below and evaluated according to the following criteria. The evaluation results are shown in Table 1.

A: $\Delta E_{AB}$ of 3 or less

B: $\Delta E_{AB}$ of 6 or less

C: $\Delta E_{AB}$ exceeding 6

$$\Delta E_{AB}=\{(L_B-L_A)^2+(a_B-a_A)^2+(b_B-b_A)^2\}^{1/2}$$

$L_A$, $a_A$, and $b_A$: L* value, a* value, and b* value at the image end on the front end side of the recording medium $L_B$, $a_B$, and $b_B$: L* value, a* value, and b* value at the image end on the rear end side of the recording medium The $\Delta E_{AB}$ of 6 or less is an allowable range for practical use, and the $\Delta E_{AB}$ of 3 or less is more preferred.

<Evaluation of Storage Properties of Toner>

After storage for 24 hours in an environment of 55° C. and 90% RH, 100 g of each of the toners is sieved with a sieving net having an opening of 106 μm, and the amount of the toner remaining on the net is measured and evaluated according to criteria below. The evaluation results are shown in Table 1.

A: Remaining amount of 0 g

B: Remaining amount of over 0 g and less than 1.0 g

C: Remaining amount of 1.0 g or more and less than 2.0 g

D: Remaining amount of 2.0 g or more

TABLE 1

| | White toner for electrostatic latent image development | Amount of crystalline resin (% by mass) | Amount of release agent (% by mass) | Amount of white pigment (% by mass) | Amount ratio (release agent/white pigment) | Toner particle diameter (μm) | Thickness of shell layer (μm) | Presence of flow tester minimum value (° C.) | Color difference | Toner storage properties |
|---|---|---|---|---|---|---|---|---|---|---|
| Example 1 | 1 | 10.7 | 6.5 | 40 | 0.16 | 8.32 | 0.16 | Yes (85° C.) | A | A (⊙) |
| Example 2 | 2 | 8 | 6.5 | 40 | 0.16 | 8.18 | 0.14 | Yes (85° C.) | B | A (⊙) |
| Example 3 | 3 | 4.9 | 6.5 | 40 | 0.16 | 8.1 | 0.15 | Yes (85° C.) | B | A (⊙) |
| Example 4 | 4 | 14.9 | 6.5 | 40 | 0.16 | 8.5 | 0.15 | Yes (84° C.) | A | B (○) |
| Example 5 | 5 | 20.4 | 6.5 | 40 | 0.16 | 8.42 | 0.16 | Yes (85° C.) | A | B (○) |
| Example 6 | 6 | 10.9 | 6.7 | 41 | 0.16 | 8.4 | 0.1 | Yes (84° C.) | B | B (○) |
| Example 7 | 7 | 11.2 | 6.9 | 42 | 0.16 | 8.2 | 0.05 | Yes (86° C.) | A | B (○) |
| Example 8 | 8 | 5.1 | 6.5 | 40 | 0.16 | 7.62 | 0.06 | Yes (85° C.) | A | B (○) |
| Example 9 | 9 | 10.7 | 6.2 | 38 | 0.16 | 8.38 | 0.29 | Yes (84° C.) | B | A (⊙) |
| Example 10 | 10 | 5 | 6.5 | 40 | 0.16 | 8.36 | 0.33 | Yes (85° C.) | B | B (○) |
| Example 11 | 11 | 15 | 6.5 | 40 | 0.16 | 8.1 | 0.05 | Yes (86° C.) | A | B (○) |
| Example 12 | 12 | 15 | 6.5 | 40 | 0.16 | 8.74 | 0.32 | Yes (85° C.) | B | B (○) |
| Example 13 | 13 | 10.7 | 5.0 | 40 | 0.13 | 8.22 | 0.16 | Yes (85° C.) | B | B (○) |
| Example 14 | 14 | 10.7 | 3.5 | 40 | 0.09 | 8.5 | 0.15 | Yes (85° C.) | B | B (○) |
| Example 15 | 15 | 10.7 | 8.0 | 40 | 0.20 | 8.12 | 0.16 | Yes (85° C.) | A | B (○) |
| Example 16 | 16 | 10.7 | 9.5 | 40 | 0.24 | 8.38 | 0.14 | Yes (84° C.) | A | B (○) |
| Example 17 | 18 | 26 | 6.5 | 40 | 0.16 | 8.3 | 0.15 | Yes (84° C.) | A | C (Δ) |
| Example 18 | 19 | 15.1 | 6.7 | 40 | 0.17 | 8.14 | 0.02 | Yes (86° C.) | A | C (Δ) |
| Example 19 | 21 | 5.2 | 6.5 | 41 | 0.16 | 7.76 | 0.03 | Yes (85° C.) | B | C (Δ) |

TABLE 1-continued

| | White toner for electrostatic latent image development | Amount of crystalline resin (% by mass) | Amount of release agent (% by mass) | Amount of white pigment (% by mass) | Amount ratio (release agent/white pigment) | Toner particle diameter (μm) | Thickness of shell layer (μm) | Presence of flow tester minimum value (° C.) | Color difference | Toner storage properties |
|---|---|---|---|---|---|---|---|---|---|---|
| Example 20 | 23 | 9.9 | 6.7 | 42 | 0.16 | 8.2 | 0.1 | Yes (84° C.) | B | A (⊙) |
| Example 21 | 24 | 10.6 | 6.5 | 40 | 0.16 | 8.4 | 0.15 | Yes (84° C.) | A | A (⊙) |
| Comparative Example 1 | 17 | 4 | 6.5 | 40 | 0.16 | 8.52 | 0.16 | No | C | A (⊙) |
| Comparative Example 2 | 20 | 15 | 6.5 | 40 | 0.16 | 8.56 | 0.38 | No | C | B (○) |
| Comparative Example 3 | 22 | 5.1 | 6.5 | 40 | 0.16 | 8.68 | 0.39 | No | C | C (Δ) |

Table 1 indicates that when the white toner having a minimum value within the temperature range of 70° C. or more and 95° C. or less, that is, the specific viscosity characteristic, is applied, it is possible to form the colored image having a little color difference between the front end and the rear end in the transport direction of the transparent recording medium.

Figure 3:
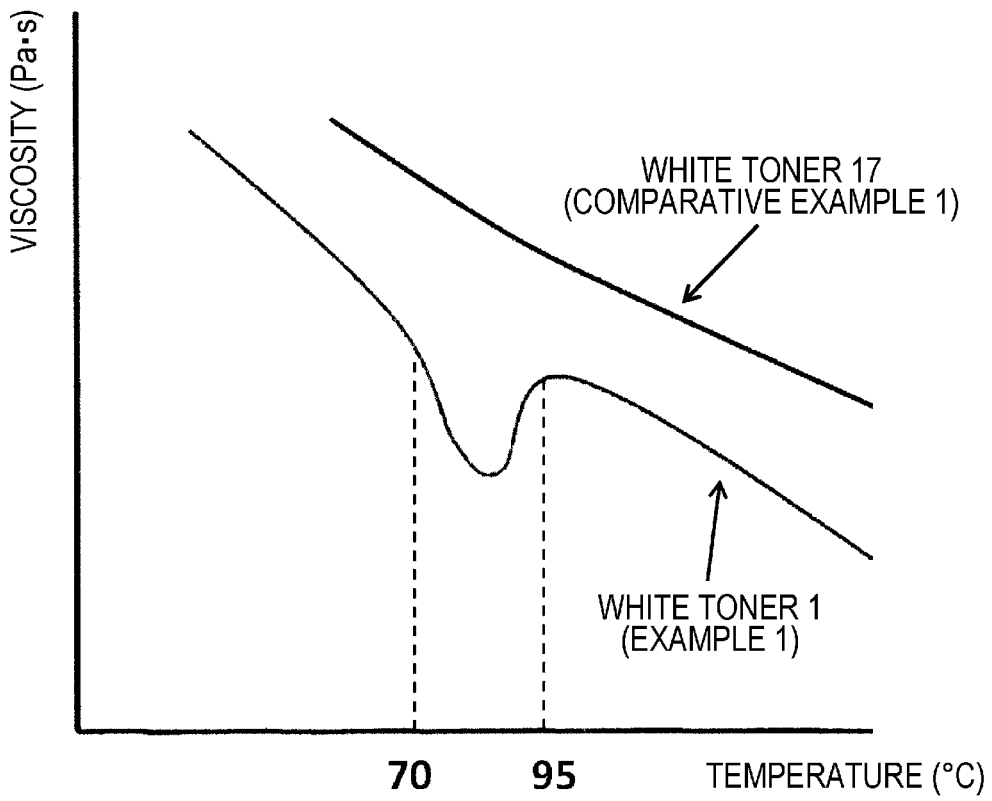
FIG. 3 is a diagram showing the temperature-viscosity curve of a toner according to an exemplary embodiment of the present invention.

FIG. 3 shows the temperature-viscosity curves obtained by measuring the white toner 1 of Example 1 and the white toner 17 of Comparative Example 1 using a flow tester.

As shown in FIG. 3, the white toner 1 of Example 1 shows a position where a decrease in viscosity per unit temperature increase is increased, and then the viscosity is increased and is again decreased. In this case, the white toner 1 is considered to have a minimum value at 85° C. While the white toner 17 of Comparative Example 1 shows no position where a decrease in viscosity per unit temperature increase is increased, and the white toner 17 does not have a minimum value.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A white toner for electrostatic latent image development, the white toner comprising:

toner particles containing a binder resin, a white pigment, and a release agent, the binder resin containing an amorphous resin, wherein in viscosity measurement using a capillary viscometer, a temperature-viscosity curve has a minimum value within a temperature range of 70° C. or more and 95° C. or less, the toner particles each have a core part, which contains the binder resin, the white pigment, and the release agent, and a shell layer which covers the core part and contains the binder resin; and the thickness of the shell layer is 0.05 μm or more and 0.35 μm or less.

2. The white toner for electrostatic latent image development according to claim 1, wherein the binder resin contains a crystalline resin, and the content of the crystalline resin relative to the toner particles is 5% by mass or more and 25% by mass or less.

3. The white toner for electrostatic latent image development according to claim 2, wherein the content of the crystalline resin is 5% by mass or more and 15% by mass or less.

4. The white toner for electrostatic latent image development according to claim 2, wherein the crystalline resin contains a crystalline polyester resin.

5. The white toner for electrostatic latent image development according to claim 4, wherein the crystalline polyester resin contains a constituent unit derived from a polyhydric carboxylic acid component which contains an aliphatic carboxylic acid having 5 or more and 12 or less carbon atoms, and a constituent unit derived from a polyhydric alcohol component which contains an aliphatic diol having 2 or more and 10 or less carbon atoms.

6. The white toner for electrostatic latent image development according to claim 1, wherein the amorphous resin contains at least one of an amorphous polyester resin and a styrene-(meth)acrylic resin.

7. The white toner for electrostatic latent image development according to claim 6, wherein the amorphous polyester resin contains a urea-modified polyester resin.

8. The white toner for electrostatic latent image development according to claim 1, wherein the thickness of the shell layer is 0.10 μm or more and 0.20 μm or less.

9. The white toner for electrostatic latent image development according to claim 1, wherein the content of the white pigment relative to the toner particles is 15% by mass or more and 45% by mass or less.

10. The white toner for electrostatic latent image development according to claim 9, wherein the content of the white pigment is 30% by mass or more and 45% by mass or less.

11. The white toner for electrostatic latent image development according to claim 1, wherein the ratio of the content of the release agent to the content of the white pigment is 0.08 or more and 0.25 or less.

12. An electrostatic image developer comprising the white toner for electrostatic latent image development according to claim 1.

13. An image forming apparatus comprising:

a first image forming unit which houses the electrostatic image developer according to claim 12 and forms a white toner image;

a second image forming unit which houses an electrostatic image developer containing a colored toner and forms a colored toner image;

a transfer unit which transfers the white toner image and the colored toner image to the surface of a recording medium; and a fixing unit which fixes the white toner image and colored toner image transferred to the surface of the recording medium.

14. The image forming apparatus according to claim 13, wherein the recording medium is a transparent recording medium.

15. A white toner for electrostatic latent image development, the white toner comprising:

toner particles containing a binder resin, a white pigment, and a release agent, the binder resin containing an amorphous resin, wherein in viscosity measurement using a capillary viscometer, a temperature-viscosity curve has a minimum value within a temperature range of 70° C. or more and 95° C. or less, the amorphous resin contains at least one of an amorphous polyester resin and a styrene-(meth)acrylic resin, and the amorphous polyester resin contains a urea-modified polyester resin.

* * * * *